US012330829B2

(12) United States Patent
Jarrell et al.

(10) Patent No.: US 12,330,829 B2
(45) Date of Patent: Jun. 17, 2025

(54) CASE SEALER CONFIGURABLE INTO A BYPASS CONFIGURATION

(71) Applicant: Signode Industrial Group LLC, Tampa, FL (US)

(72) Inventors: Diana Jarrell, Streamwood, IL (US); Michael Trevor Wolf, Chicago, IL (US)

(73) Assignee: SIGNODE INDUSTRIAL GROUP LLC, Tampa, FL (US)

( * ) Notice: Subject to any disclaimer, the term of this patent is extended or adjusted under 35 U.S.C. 154(b) by 0 days.

(21) Appl. No.: 18/335,568

(22) Filed: Jun. 15, 2023

(65) Prior Publication Data

US 2024/0010375 A1 Jan. 11, 2024

Related U.S. Application Data

(60) Provisional application No. 63/367,660, filed on Jul. 5, 2022.

(51) Int. Cl.

| | |
|---|---|
| ***B65B 51/06*** | (2006.01) |
| ***B65B 7/20*** | (2006.01) |
| ***B65B 57/02*** | (2006.01) |
| ***B65B 61/06*** | (2006.01) |

(52) U.S. Cl.

CPC ..... *B65B 51/067* (2013.01); *B65B 7/20* (2013.01); *B65B 57/02* (2013.01); *B65B 61/06* (2013.01)

(58) Field of Classification Search

None

See application file for complete search history.

(56) References Cited

U.S. PATENT DOCUMENTS

| | | | | |
|---|---|---|---|---|
| 3,892,618 | A | 7/1975 | Griebat | |
| 3,915,786 | A | 10/1975 | Collett et al. | |
| 3,954,550 | A | 5/1976 | Patterson | |
| 4,238,269 | A | 12/1980 | Deering | |
| 4,295,771 | A | 10/1981 | Mehesan | |
| 4,781,786 | A * | 11/1988 | Lerner | B65B 51/067 156/468 |
| 5,066,346 | A | 11/1991 | Long et al. | |
| 5,173,140 | A | 12/1992 | Vasilakes | |
| 5,227,002 | A | 7/1993 | Faust et al. | |
| 5,300,181 | A | 4/1994 | Yamaguchi | |
| 5,338,384 | A * | 8/1994 | Reichert | B65B 51/067 156/212 |
| 5,454,776 | A | 10/1995 | Ulrich et al. | |

(Continued)

FOREIGN PATENT DOCUMENTS

| | | | |
|---|---|---|---|
| CA | 978914 | A | 12/1975 |
| CN | 201424150 | Y | 3/2010 |

(Continued)

OTHER PUBLICATIONS

"Extended European Search Report", from corresponding European Patent Application No. EP23183533.1, Dec. 19, 2023.

*Primary Examiner* — Tanzim Imam

(74) *Attorney, Agent, or Firm* — Neal, Gerber & Eisenberg LLP

(57) ABSTRACT

Various embodiments of the present disclosure provide a random case sealer configurable into a bypass configuration in which a tape cartridge is out of the path of a case so the tape cartridge does not apply tape to the case as the case moves past the tape cartridge.

20 Claims, 18 Drawing Sheets

(56) References Cited

U.S. PATENT DOCUMENTS

| | | | |
|---|---|---|---|
| 7,571,588 | B2 | 8/2009 | Sambuca et al. |
| 7,819,357 | B2 | 10/2010 | Fox et al. |
| 7,926,536 | B2 | 4/2011 | Fox et al. |
| 7,937,905 | B2 | 5/2011 | Fox et al. |
| 7,946,327 | B2 | 5/2011 | Fox et al. |
| 7,946,328 | B2 | 5/2011 | Fox et al. |
| 8,079,395 | B2 | 12/2011 | Fox et al. |
| 8,452,852 | B2 | 5/2013 | Jachner |
| 9,517,914 | B2 | 12/2016 | Menta et al. |
| 9,630,796 | B2 | 4/2017 | Menta et al. |
| 10,532,842 | B1 | 1/2020 | Zoss et al. |
| 10,723,496 | B2 | 7/2020 | Riswick et al. |
| 11,242,169 | B2 | 2/2022 | Menta et al. |
| 11,358,744 | B2 | 6/2022 | Menta et al. |
| 11,492,163 | B2 | 11/2022 | Menta et al. |
| 11,584,010 | B2 | 2/2023 | Hill et al. |
| 11,801,957 | B2 | 10/2023 | Monti |
| 2004/0108074 | A1 | 6/2004 | Marchetti |
| 2009/0021753 | A1 | 1/2009 | Ferman et al. |
| 2009/0064636 | A1* | 3/2009 | Chu ..... B65B 59/02 156/468 |
| 2009/0217535 | A1 | 9/2009 | Fox et al. |
| 2009/0218047 | A1 | 9/2009 | Fox et al. |
| 2009/0218048 | A1 | 9/2009 | Fox et al. |
| 2010/0175836 | A1 | 7/2010 | Lam |
| 2012/0232699 | A1 | 9/2012 | Menta et al. |
| 2021/0300611 | A1 | 9/2021 | Menta |
| 2022/0063854 | A1 | 3/2022 | Bern et al. |
| 2022/0081145 | A1 | 3/2022 | Chu et al. |
| 2022/0089308 | A1 | 3/2022 | Monti |
| 2022/0161505 | A1 | 5/2022 | Hivatal et al. |
| 2022/0396449 | A1 | 12/2022 | Russell et al. |
| 2023/0089892 | A1 | 3/2023 | Johnson |
| 2023/0182945 | A1 | 6/2023 | Monti |
| 2023/0382056 | A1 | 11/2023 | Walker et al. |

FOREIGN PATENT DOCUMENTS

| | | | |
|---|---|---|---|
| CN | 201424151 | Y | 3/2010 |
| CN | 101804924 | A | 8/2010 |
| DE | 3820060 | A1 | 12/1989 |
| DE | 60105613 | T2 | 10/2004 |
| EP | 0460878 | A2 | 12/1991 |
| EP | 3885278 | A1 | 9/2021 |
| GB | 1340175 | A | 12/1973 |
| JP | 2004276951 | A | 10/2004 |

* cited by examiner

CASE SEALER CONFIGURABLE INTO A BYPASS CONFIGURATION

PRIORITY

This application claims priority to and the benefit of U.S. Provisional Patent Application No. 63/367,660, filed Jul. 5, 2022, the entire contents of which is incorporated herein by reference.

FIELD

The present disclosure relates to case sealers, and more particularly to random case sealers configured to seal cases of different heights.

BACKGROUND

Every day, companies around the world pack millions of items in cases, such as corrugated boxes, to prepare them for shipping. Case sealers help automate this process by applying pressure-sensitive tape to cases already packed with items and protective dunnage (such as bubble wrap) to seal those cases shut.

Random case sealers automatically adjust to the height of the incoming case so they can seal cases of different heights without operator intervention. A typical random case sealer includes a frame including two lower drive belts; a lower tape cartridge removably mounted to the frame between the lower drive belts; a mast mounted to the frame; and a top-head assembly movably mounted to the mast and including two upper drive belts, an upper tape cartridge, and a pressure switch. The lower tape cartridge applies tape to the leading, bottom, and trailing surfaces of the case as the upper and lower drive belts move the case past the lower tape cartridge, and the upper tape cartridge applies tape to the leading, upper, and trailing surfaces of the case as the upper and lower drive belts move the case past the upper tape cartridge.

To seal a case using a random case sealer, an operator, such as a person or an automatic case-feeding system, moves the case into contact with the pressure switch. In response, an actuator begins raising the top-head assembly. Once the top-head assembly ascends above the case so the case stops contacting the pressure switch, the operator moves the case beneath the top-head assembly and holds it there as the top-head assembly descends. Once the upper drive belts of the top-head assembly contact the top surface of the case, the operator releases the case and the drive belts move the case relative to the tape cartridges, which apply tape to the case as the case moves past the tape cartridges.

The tape cartridges include multiple components that cooperate to apply tape to the case. For instance, each tape cartridge includes multiple rollers that force the tape onto multiple surfaces of the case; a cutter that cuts the tape from a tape supply (such as a roll of tape); and a wipe-down element, such as a brush, that extends past the drive belt and into the path of the case near the downstream end of the tape cartridge. As the case moves past the tape cartridges, the wipe-down elements engage and force the tape into contact with the case to ensure good adhesion.

In certain scenarios, such as when an incoming case has already been sealed, the operator does not want the case sealer to apply tape to the case. To avoid the need for the operator to manually move these cases to bypass the case sealer (and its taping process), there is a need for random case sealers that are configurable to enable these cases to pass through the case sealers without being taped.

SUMMARY

Various embodiments of the present disclosure provide a random case sealer configurable into a bypass configuration in which a tape cartridge is out of the path of a case so the tape cartridge does not apply tape to the case as the case moves past the tape cartridge.

One embodiment of the case sealer of the present disclosure includes a frame; a lower drive element supported by the frame; a lower-drive-element actuator operably connected to and configured to drive the lower drive element; a tape cartridge including a roller, wherein the tape cartridge is supported by the frame and movable relative to the lower drive element between a home position and a bypass position; and a tape-cartridge mover operably connected to the tape cartridge and configured to move the tape cartridge from the home position to the bypass position to lower the roller.

One method of operating a case sealer of the present disclosure to move a case past a tape cartridge of the case sealer without applying tape to the case includes, responsive to a bypass condition being met, switching the case sealer into a bypass configuration in which a roller of the tape cartridge is not above an upper surface of a lower drive element of the case sealer; and actuating the lower drive element to move the case past the tape cartridge case sealer is in the bypass configuration.

DETAILED DESCRIPTION

Figure 1:
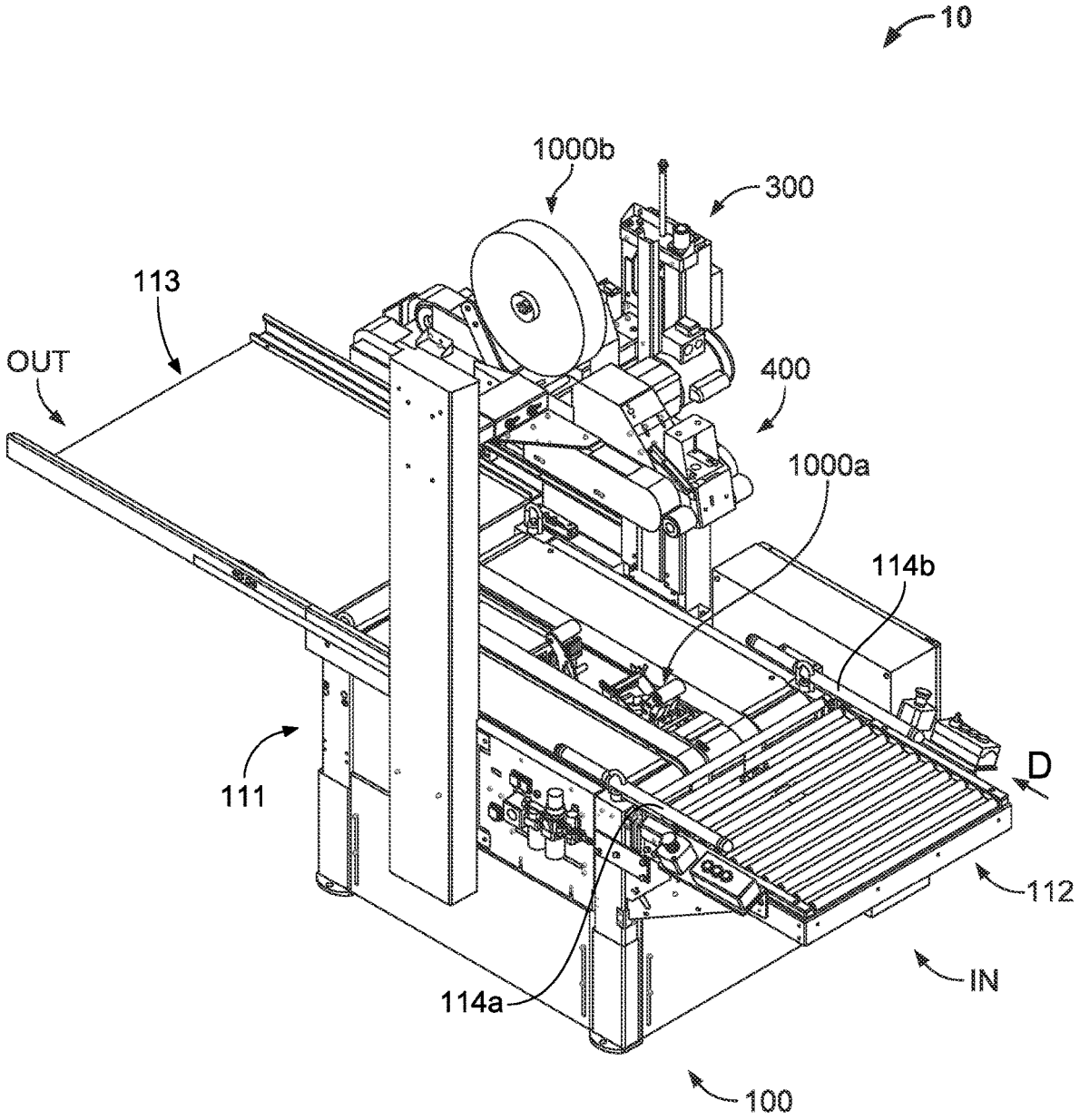
FIG. 1 is a perspective view of one example embodiment of a case sealer of the present disclosure.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connection of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as coupled, mounted, connected, etc., are not intended to be limited to direct mounting methods, but should be interpreted broadly to include indirect and operably coupled, mounted, connected, and like mounting methods. This specification is intended to be taken as a whole and interpreted in accordance with the principles of the present disclosure and as understood by one of ordinary skill in the art.

Various embodiments of the present disclosure provide a random case sealer configurable into a bypass configuration in which a tape cartridge is out of the path of a case so the tape cartridge does not apply tape to the case as the case moves past the tape cartridge.

Figure 2:
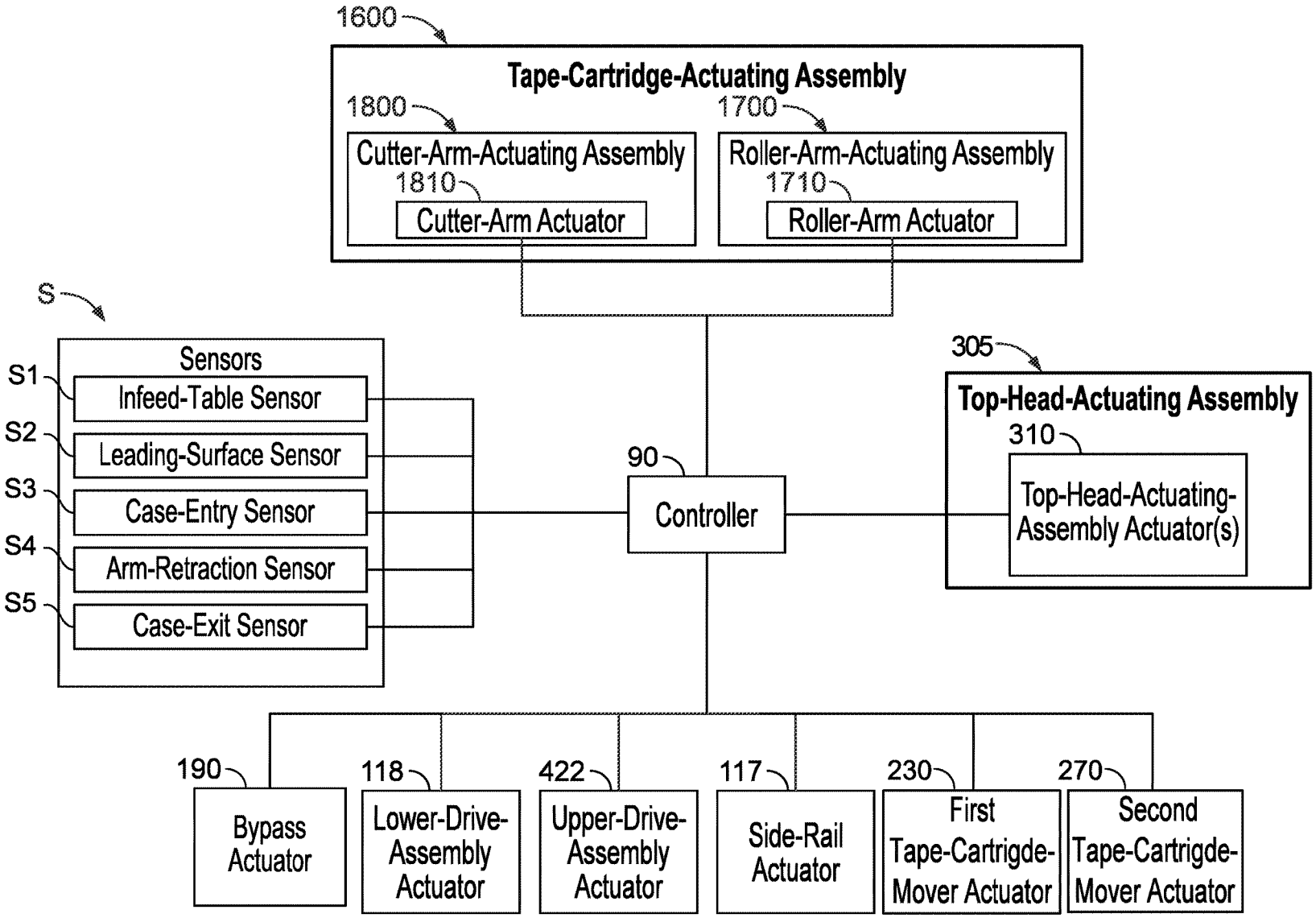
FIG. 2 is a block diagram showing certain components of the case sealer of FIG. 1.

FIG. 1-9H show one example embodiment of a case sealer 10 of the present disclosure and components thereof. The case sealer 10 includes a base assembly 100, a bypass actuator 190, a tape-cartridge-mover assembly 200, a mast assembly 300, a top-head assembly 400, a lower tape cartridge 1000*a*, and an upper tape cartridge 1000*b*. As shown in FIG. 2, the case sealer 10 also includes multiple actuating assemblies and actuators operably connected to and configured to control movement of certain components of the case sealer 10; multiple sensors S1-S5; and control circuitry and systems for controlling the actuating assemblies and the actuators (and other mechanical, pneumatic, electro-mechanical, and electrical components of the case sealer 10) responsive to signals received from the sensors S.

The case sealer 10 also includes a controller 90 communicatively connected to the sensors S to send and receive signals to and from the sensors S. The controller 90 is operably connected to the actuating assemblies and the actuators to control the actuating assemblies and the actuators. The controller 90 may be any suitable type of controller (such as a programmable logic controller) that includes any suitable processing device(s) (such as a microprocessor, a microcontroller-based platform, an integrated circuit, or an application-specific integrated circuit) and any suitable memory device(s) (such as random access memory, read-only memory, or flash memory). The memory device(s) stores instructions executable by the processing device(s) to control operation of the case sealer 10.

As described in detail below, the case sealer 10 is configured to apply tape to cases to seal the cases as they pass through the case sealer 10. One or more components of the case sealer 10 are movable to configure the case sealer 10 into a bypass configuration. When in the bypass configuration, the case sealer 10 enables cases to pass through the case sealer 10 without applying any tape to the cases.

Figure 3:
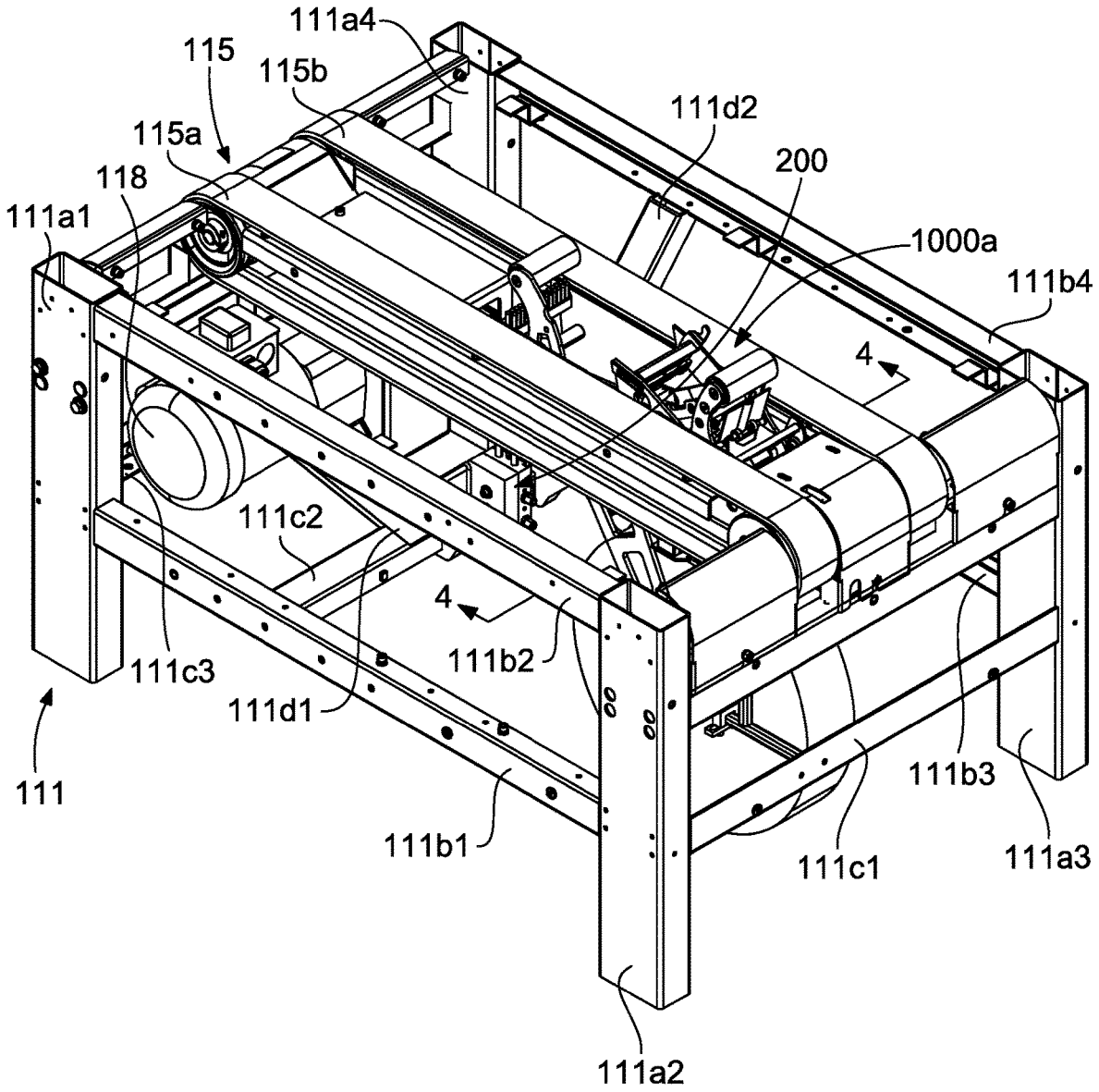
FIG. 3 is a perspective view of parts of the base assembly, the tape-cartridge-mover assembly, and the lower tape cartridge of the case sealer of FIG. 1.

The base assembly 100, which is best shown in FIGS. 1 and 3, is configured to align cases in preparation for sealing (or bypass) and to (along with the top-head assembly 400) move the cases through the case sealer 10. The base assembly 100 supports the tape-cartridge-mover assembly 200, the lower tape cartridge 1000*a*, and the mast assembly 300 (which in turn supports the top-head assembly 400 that includes the upper tape cartridge 1000*b*). The base assembly 100 includes a base-assembly frame 111, an infeed table 112, an outfeed table 113, a side-rail assembly (not labeled), and a lower drive assembly 115. The base assembly 100 defines an infeed end IN (FIG. 1) of the case sealer 10 at which an operator (such as a person or an automated case-feeding system) feeds incoming cases into the case sealer 10 (via the infeed table 112) and an outfeed end OUT (FIG. 1) of the case sealer 10 at which the case sealer 10 ejects cases onto the outfeed table 113.

The base-assembly frame 111 is configured to support various components of the case sealer 10 and is formed from any suitable combination of solid and/or tubular members and/or plates fastened together. In this example embodiment, the base-assembly frame 111 includes upright legs Mal, 111*a*2, 111*a*3, and 111*a*4; longitudinal rails 111*b*1, 111*b*2, 111*b*3, and 111*b*4; transverse rails 111*c*1, 111*c*2, and 111*c*3; and angled rails 111*d*1 and 111*d*2. The longitudinal rails 111*b*1 and 111*b*2 extend between and connect the legs 111*a*1 and 111*a*2, and the longitudinal rails 111*b*3 and 111*b*4 extend between and connect the legs 111*a*3 and 111*a*4. The transverse rail 111*c*1 extends between and connects the legs 111*a*2 and 111*a*3, the transverse rail 111*c*2 extends between and connects the longitudinal rails 111*b*1 and 111*b*3, and the transverse rail 111*c*3 extends between and connects the legs 111*a*1 and 111*a*4. The angled rail 111*d*1 extends between and connects the longitudinal rail 111*b*2 and the transverse rail 111*c*2, and the angled rail 111*d*2 extends between and connects the longitudinal rail 111*b*4 and the transverse rail 111*c*2.

The infeed table 112 is mounted to the base-assembly frame 111 adjacent the infeed end IN of the case sealer 10. The infeed table 112 includes multiple rollers on which the operator can place and fill a case and then use to convey the filled case toward the top-head assembly 400. The infeed table 112 includes an infeed-table sensor S1 (FIG. 2), which may be any suitable sensor (such as a photoelectric sensor) configured to detect the presence of a case on the infeed table 112 and, more particularly, the presence of a case at a particular location on the infeed table 112 that corresponds to the location of the infeed-table sensor S1. In other embodiments, another component of the case sealer 10 includes the infeed-table sensor S1. The infeed-table sensor S1 is communicatively connected to the controller 90 to send signals to the controller 90 responsive to detecting a case (a case-detected signal) and, afterwards, no longer detecting the case (a case-undetected signal), as described below.

The outfeed table 113 is mounted to the base-assembly frame 111 adjacent the outfeed end OUT of the case sealer 10. The outfeed table 113 includes a generally planar surface onto which the case is ejected after moving past the tape cartridges, though it may include multiple rollers in other embodiments.

The side-rail assembly is supported by the base-assembly frame 111 adjacent the infeed table 112 and includes first and second side rails 114*a* and 114*b* and a side-rail actuator 117 (FIG. 2). The side rails 114*a* and 114*b* extend generally parallel to a direction of travel D (FIG. 1) of a case through the case sealer 10 and are movable laterally inward (relative to the direction of travel D) to laterally center the case on the infeed table 112. The side-rail actuator 117 is operably connected to the first and second side rails 114*a* and 114*b* (either directly or via suitable linkages) to move the side rails between: (1) a rest configuration (FIG. 1) in which the side rails are positioned at or near the lateral extents of the infeed table 112 to enable an operator to position a case between the side rails on the infeed table 112; and (2) a centering configuration (not shown) in which the side rails (after being moved toward one another) contact the case and center the case on the infeed table 112. The controller 90 is operably connected to the side-rail actuator 117 to control the side-rail actuator 117 to move the side rails 114*a* and 114*b* between the rest and centering configurations. The side-rail actuator 117 may be any suitable type of actuator, such as a motor or a pneumatic cylinder fed with pressurized gas and controlled by one or more valves.

The lower drive assembly 115 is supported by the base-assembly frame 111 and (along with an upper drive assembly 420, described below) configured to move cases in the direction D. The lower drive assembly 115 includes first and second lower drive elements 115*a* and 115*b* (though it may include only one drive element or more than two drive elements in other embodiments) and a lower-drive-assembly actuator 118 operably connected to the first and second lower drive elements 115*a* and 115*b* and configured to drive the first and second lower drive elements to (along with the upper drive assembly 420) move cases through the case sealer 10. In this example embodiment, the lower-drive-assembly actuator 118 includes a motor that is operably connected to the first and second lower drive elements 115*a* and 115*b*—which include endless belts in this example embodiment—via one or more other components, such as sprockets, gearing, screws, tensioning elements, and/or a chain. The lower-drive-assembly actuator 118 may include any other suitable actuator in other embodiments. The first and second lower drive elements 115*a* and 115*b* may include any other suitable component or components, such as rollers, in other embodiments. The controller 90 is operably connected to the lower-drive-assembly actuator 118 to control operation of the lower-drive-assembly actuator 118.

The lower drive assembly 115 supports a case-entry sensor S3 downstream of the infeed table 112, downstream of the leading-surface sensor S2 (described below), and beneath the top-head assembly 400 so the case-entry sensor S3 can detect when a case enters the area below the top-head assembly 400. As used herein, "downstream" means in the direction of travel D, and "upstream" means the direction opposite the direction of travel D. Also, unless explicitly stated otherwise, "above" and "below" as used herein mean "in a plane above" and "in a plane below" and not "directly above" or "directly below." The case-entry sensor S3 includes a proximity sensor (or any other suitable sensor, such as a mechanical sensor) configured to detect the presence of a case. In other embodiments, the case-entry sensor S3 is supported by the mast assembly 300 or the top-head assembly 400. The case-entry sensor S3 is communicatively connected to the controller 90 to send signals to the controller 90 responsive to detecting the case (a case-detected signal) and no longer detecting the case (a case-undetected signal).

The base-assembly frame 111 supports a case-exit sensor S5 that includes a proximity sensor (or any other suitable sensor) configured to detect the presence of a case. Here, although not shown, the case-exit sensor S5 is positioned near the outfeed table 113 (downstream of the case-entry and arm-retraction sensors S3 and S4 described below) so the case-exit sensor S5 can detect when a case exits from beneath the top-head assembly 400. The case-exit sensor S5 is communicatively connected to the controller 90 to send signals to the controller 90 responsive to detecting the case (a case-detected signal) and no longer detecting the case (a case-undetected signal). In other embodiments, the case-exit sensor S5 is part of the top-head assembly 400.

The bypass actuator 190 includes any suitable device configured to be actuated by the operator, such as a foot pedal, a hand lever, or a button.

Figure 6:
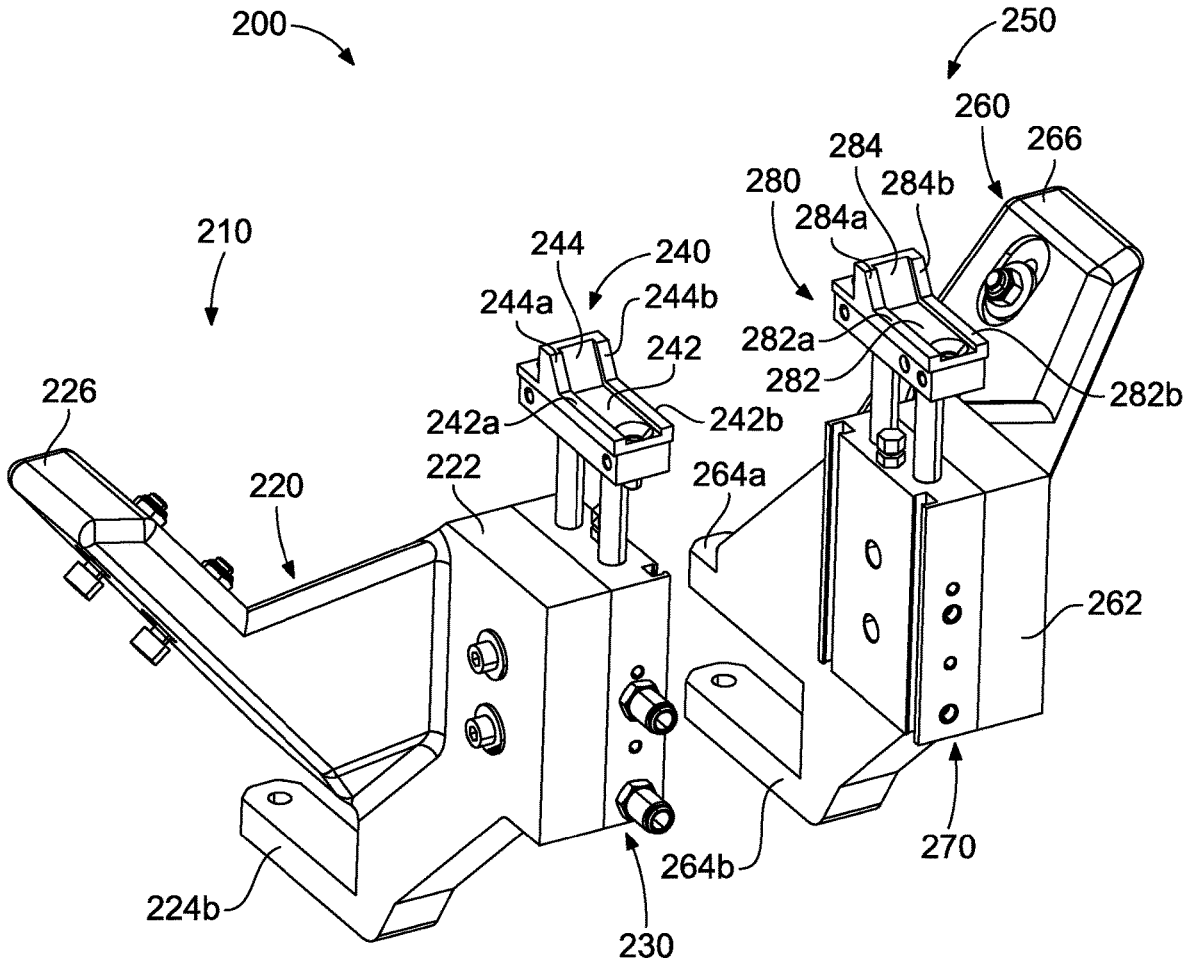
FIGS. 6 and 7 are perspective views of the tape-cartridge-mover assembly of the case sealer of FIG. 1.
Figure 7:
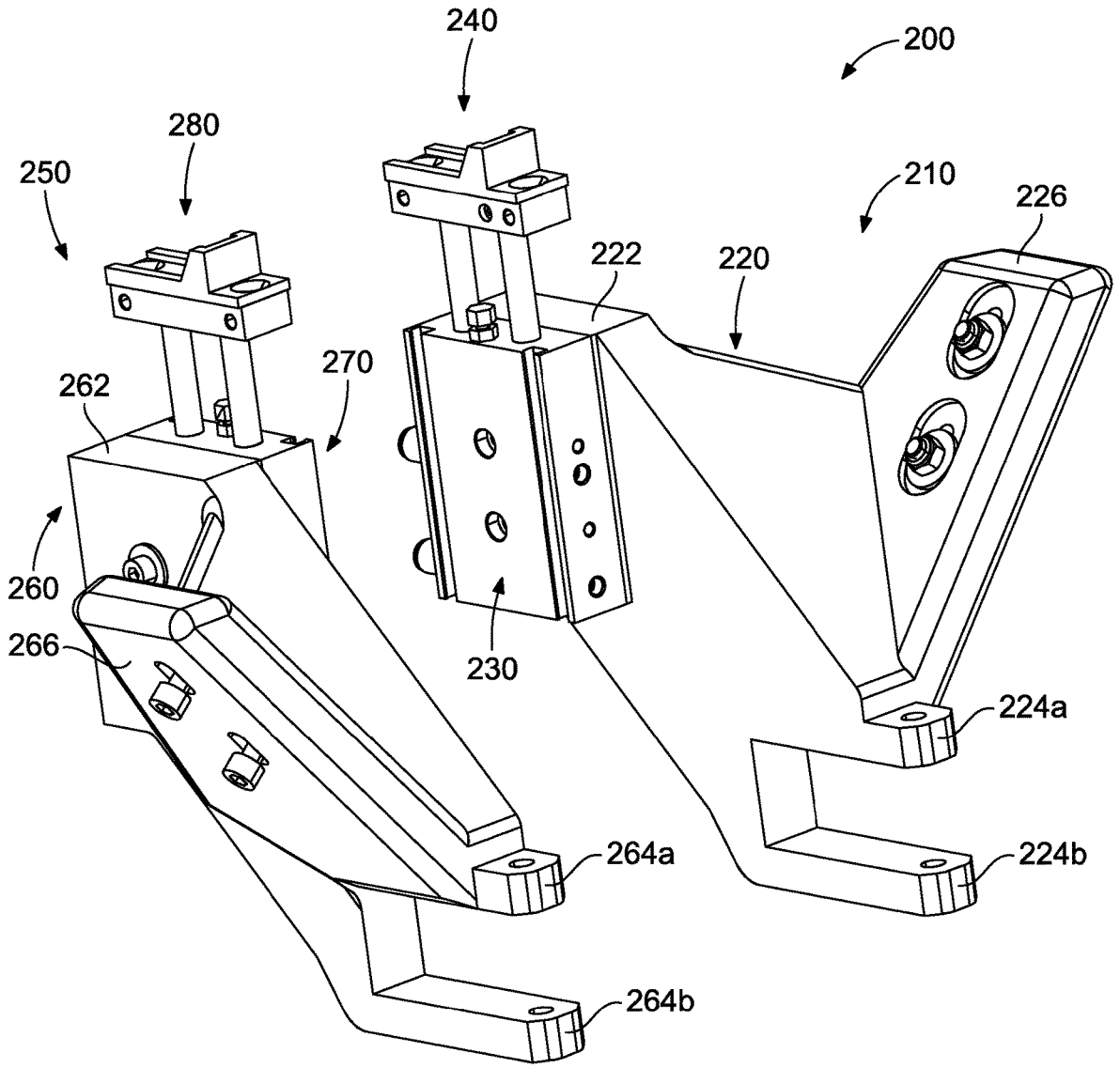

The tape-cartridge-mover assembly 200 is mounted to the base-assembly frame 111, cooperates with the base-assembly frame 111 to support the lower tape cartridge 1000*a*, and is operably connected to the lower tape cartridge 1000*a* to move the lower tape cartridge 1000*a* between a home position and a bypass position, described below with respect to FIGS. 10A-10C. As best shown in FIGS. 6 and 7, the tape-cartridge-mover assembly 200 includes a first tape-cartridge mover 210 and a second tape-cartridge mover 250 that are mirror images of one another in this example embodiment.

The first tape-cartridge mover 210 includes a first mount 220, a first tape-cartridge-mover actuator 230, and a first tape-cartridge support 240. The first mount 220 includes a base 222, a first mounting foot 224*a* extending from the base 222, a second mounting foot 224*b* extending from the base 222 and spaced-apart from the first mounting foot 224*a*, and a wing 226 extending from the base 222. This is merely one example configuration of the first mount, which may have any other suitable configuration (such as a configuration within a wing) in other embodiments. The first tape-cartridge-mover actuator 230 includes a pneumatic actuator in this example embodiment but may include any other suitable actuator (such as a motor or a hydraulic actuator) in other embodiments. The first tape-cartridge support 240 includes a generally planar base 242 flanked by opposing lips 242*a* and 242*b* and wall 244 extending transversely from the base 242 and flanked by opposing lips 244*a* and 244*b*.

The second tape-cartridge mover 250 includes a second mount 260, a second tape-cartridge-mover actuator 270, and a second tape-cartridge support 280. The second mount 260 includes a base 262, a first mounting foot 264*a* extending from the base 262, a second mounting foot 264*b* extending from the base 262 and spaced-apart from the first mounting foot 264*a*, and a wing 266 extending from the base 262. This is merely one example configuration of the second mount, which may have any other suitable configuration (such as a configuration within a wing) in other embodiments. The second tape-cartridge-mover actuator 270 includes a pneumatic actuator in this example embodiment, but may include any other suitable actuator (such as a motor or a hydraulic actuator) in other embodiments. The second tape-cartridge support 280 includes a generally planar base 282 flanked by opposing lips 282*a* and 282*b* and wall 284 extending transversely from the base 282 and flanked by opposing lips 284*a* and 284*b*.

The first tape-cartridge-mover actuator 230 is attached to the base 222 of the first mount 220, such as via suitable fasteners, and the first tape-cartridge support 240 is attached to the first tape-cartridge-mover actuator 230, such as via suitable fasteners. The second tape-cartridge-mover actuator 270 is attached to the base 262 of the second mount 260, such as via suitable fasteners, and the second tape-cartridge support 280 is attached to the second tape-cartridge-mover actuator 270, such as via suitable fasteners. The first and second tape-cartridge-mover actuators 230 and 270 are operably connected to the first and second tape-cartridge supports 240 and 280, respectively, and configured to move the first and second tape-cartridge supports 240 and 280 between respective home positions (FIGS. 10A and 10B) and bypass positions (FIG. 10C). The controller 90 is operably connected to the first and second tape-cartridge-mover actuators 230 and 270 to control movement of the first and second tape-cartridge supports 240 and 280 between their respective home and bypass positions.

As noted above, the tape-cartridge-mover assembly 200 is mounted to the base-assembly frame 111. Specifically, in this example embodiment and as best shown in Figure the transverse rail 111*c*2 is received between the first and second mounting feet 224*a* and 224*b*, and the 226 is attached to the angled rail 111*d*1 (such as via suitable fasteners) to mount the first tape-cartridge mover 210 to the base-assembly frame 111. Similarly, the transverse rail 111*c*2 is received between the first and second mounting feet 264*a* and 264*b*, and the 266 is attached to the angled rail 111*d*2 (such as via suitable fasteners) to mount the second tape-cartridge mover 250 to the base-assembly frame 111. Once mounted, the first and second tape-cartridge-mover actuators 230 and 270 are spaced-apart by a distance that is at least the width of the tape.

While the tape-cartridge mover assembly includes two tape-cartridge movers in this example embodiment, other embodiments can include only one tape-cartridge mover or more than two tape-cartridge movers.

The mast assembly 300 is configured to support and control vertical movement of the top-head assembly 400 relative to the base assembly 100. The mast assembly 300 includes a top-head-actuating assembly 305 that includes one or more top-head-actuating-assembly actuators 310 (FIG. 2) operably connected to the top-head assembly 400 and configured to move the top-head assembly 400 toward and away from the base assembly 100. In this example embodiment, the top-head-assembly actuator includes a pneumatic cylinder fed with pressurized gas and controlled by one or more valves, though it may be any other suitable type of actuator (such as a motor) in other embodiments. The controller 90 is operably connected to the top-head-assembly actuator(s) to control vertical movement of the top-head assembly 400.

Figure 8:
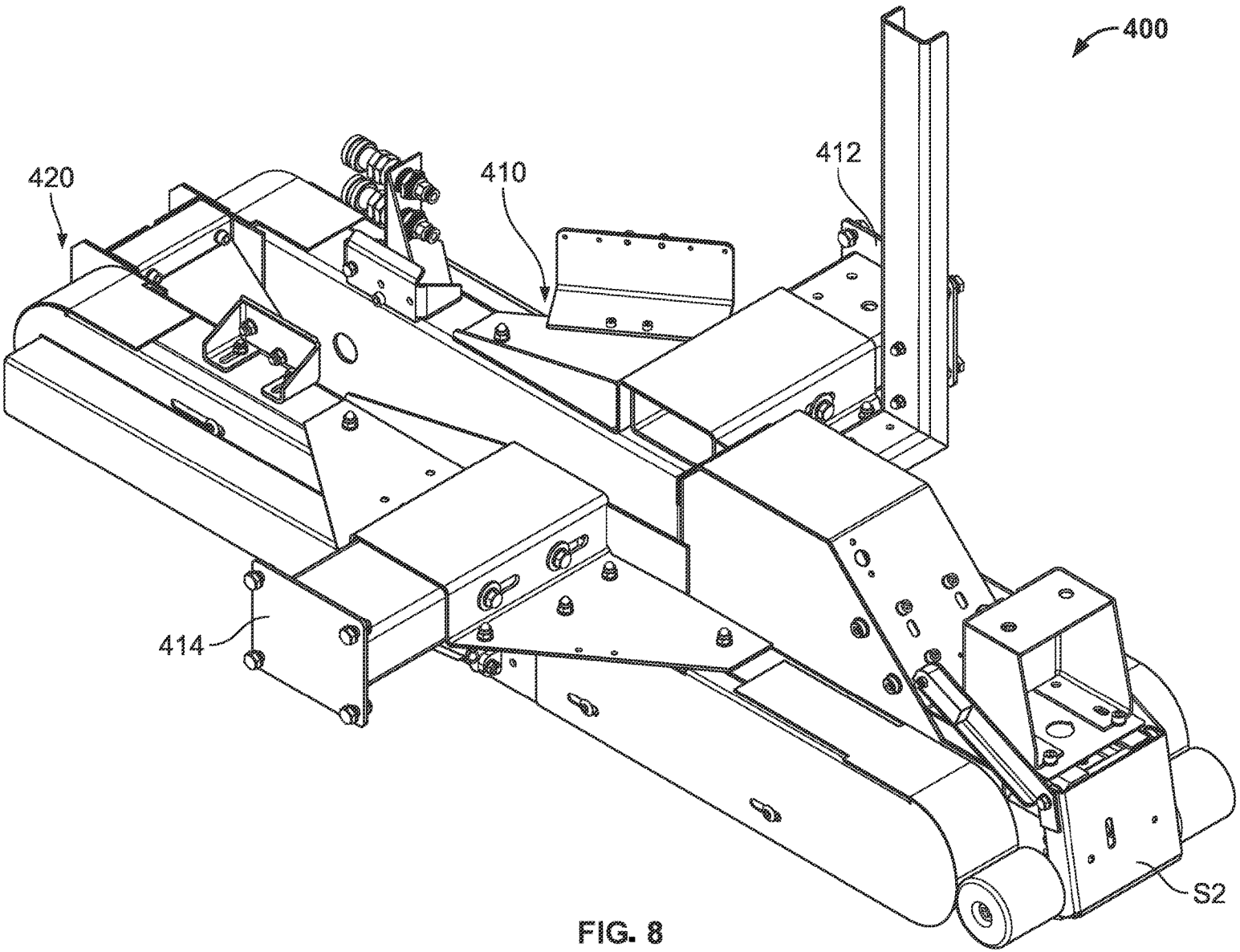
FIG. 8 is a perspective view of the top-head assembly of the case sealer of FIG. 1.

The top-head assembly 400 is movably supported by the mast assembly 300 to adjust to cases of different heights and is configured to move the cases through the case sealer 10, engage the top surfaces of the cases while doing so (except during the case-bypass process), and support the upper tape cartridge 1000*b*. As best shown in FIGS. 2 and 8, the top-head assembly 400 includes a top-head-assembly frame 410, an upper drive assembly 420, a leading-surface sensor S2, and an arm-retraction sensor S4. In other embodiments, one or more other components of the case sealer 10 (such as the base assembly 100 and/or the mast assembly 300) include the one or more of the sensors S2, S4, and S5.

The top-head-assembly frame 410 is configured to mount the top-head assembly 400 to the mast assembly 300 and to support the other components of the top-head assembly 400. The top-head-assembly frame 410 is formed from any suitable combination of solid or tubular members and/or plates fastened together. The top-head-assembly frame 410 includes laterally extending first and second mounting arms 412 and 414 to which the top-head-assembly actuator 310 of the mast assembly 300 is operatively connected.

The upper drive assembly 420 is supported by the top-head-assembly frame 410 and (along with the lower drive assembly 115, described above) configured to move cases in the direction D. The upper drive assembly 420 includes an upper drive element (or in other embodiments multiple upper drive elements) and an upper-drive-assembly actuator 422 (FIG. 2) operably connected to the upper drive element to drive the upper drive element to (along with the lower drive assembly 115) move cases through the case sealer 10. In this example embodiment, the upper-drive-assembly actuator 422 includes a motor that is operably connected to the upper drive element—which includes an endless belt in this example embodiment—via one or more other components, such as sprockets, gearing, screws, tensioning elements, and/or a chain. The upper-drive-assembly actuator 422 may include any other suitable actuator in other embodiments. The upper drive element may include any other suitable component or components, such as rollers, in other embodiments. The controller 90 is operably connected to the upper-drive-assembly actuator 422 to control operation of the upper-drive-assembly actuator 422.

The leading-surface sensor S2 includes a mechanical paddle switch (or any other suitable sensor, such as a proximity sensor) positioned at a front end of the top-head-assembly frame 410 and configured to detect when the leading surface of a case initially contacts (or is within a predetermined distance of) the top-head assembly 400. The leading-surface sensor S2 is communicatively connected to the controller 90 to send signals to the controller 90 responsive to actuation (a case-detected signal) and de-actuation (a case-undetected signal) of the leading-surface sensor S2 (corresponding to the leading-surface sensor S2 detecting and no longer detecting the case and/or an object).

The arm-retraction sensor S4 includes a proximity sensor (or any other suitable sensor) configured to detect the presence of a case. Here, although not shown, the arm-retraction sensor S4 is positioned on the underside of the top-head-assembly frame 410 downstream of the case-entry sensor S3 so the arm-retraction sensor S4 can detect when a case reaches a particular position underneath the top-head assembly 400 (here, a position just before the case contacts the front rollers of the tape cartridges, as explained below). The arm-retraction sensor S4 is communicatively connected to the controller 90 to send signals to the controller 90 responsive to detecting the case (a case-detected signal) and no longer detecting the case (a case-undetected signal).

The controller 90 is operably connected to: (1) the top-head-actuating assembly 305 and configured to control the top-head-actuating assembly 305 to control vertical movement of the top-head assembly 400 responsive to signals received from the sensors S2, S3, and S5; and (2) the lower tape cartridge 1000*a* and the upper tape cartridge 1000*b* and configured to control the force-reduction functionality of these tape cartridges responsive to signals received from the arm-retraction sensor S4, as described in detail below in conjunction with FIGS. 9A-9H.

The lower tape cartridge 1000*a* is configured to apply tape to a leading surface, a bottom surface, and a trailing surface of the case, and the upper tape cartridge 1000*b* is configured to apply tape to the leading surface, a top surface, and the trailing surface of a case. In this example embodiment, the lower and upper tape cartridges are identical and identified using the element number 1000 in FIGS. 9A-9H and referred to in the accompanying description as the "tape cartridge."

Figure 9A:
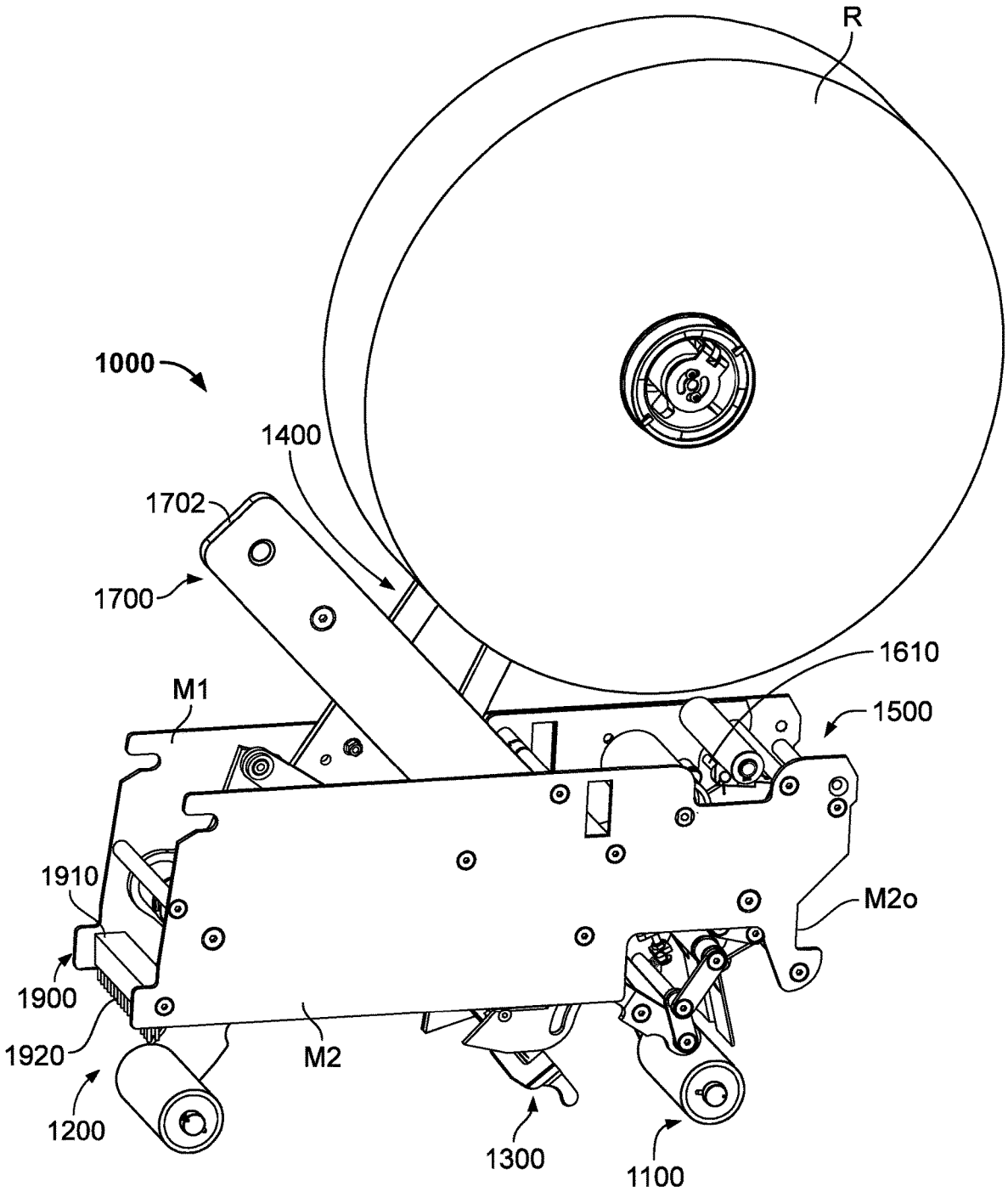
FIGS. 9A-9H are various views of the tape cartridge of the case sealer of FIG. 1.
Figure 9B:
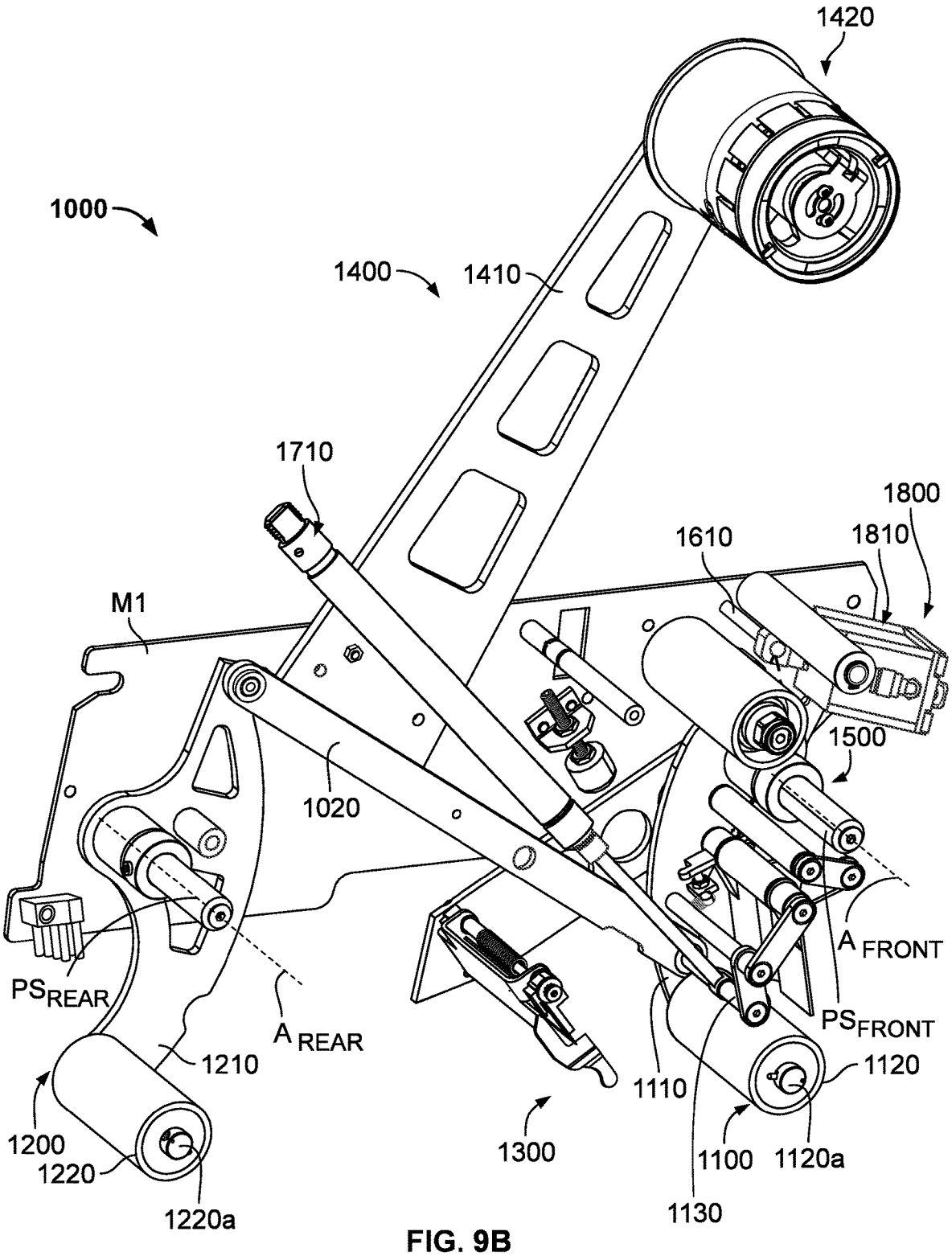
Figure 9C:
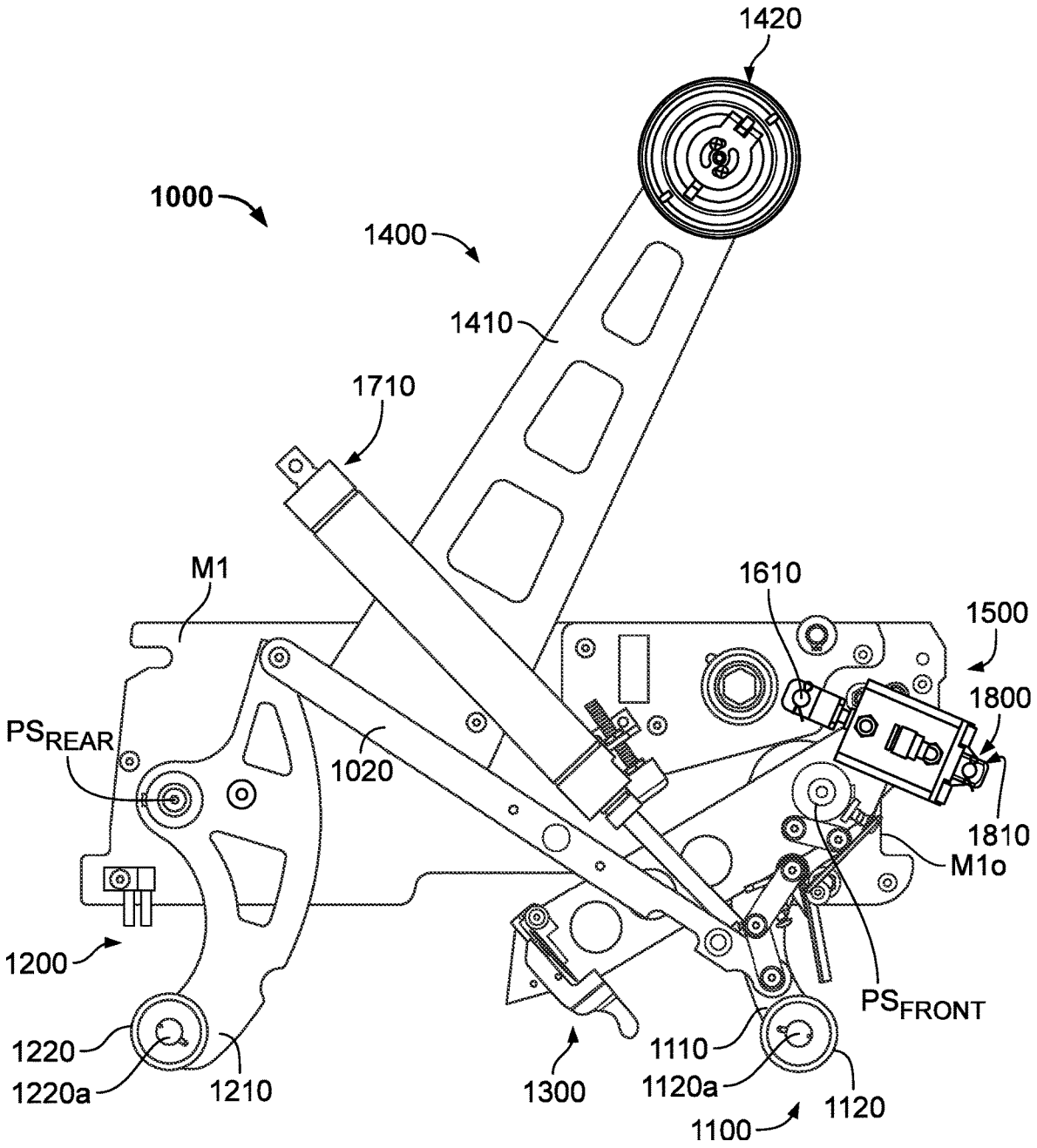

The tape cartridge 1000 includes a first mounting plate M1 that supports a front roller assembly 1100, a rear roller assembly 1200, a cutter assembly 1300, a tape-mounting assembly 1400, a tension-roller assembly 1500, a tape-cartridge-actuating assembly 1600, and a wipe-down element 1900. As best shown in FIG. 9A, a second mounting plate M2 is mounted to the first mounting plate M1 via multiple spacer shafts and fasteners (not labeled) to partially enclose certain elements of the front roller assembly 1100, the rear roller assembly 1200, the cutter assembly 1300, the tape-mounting assembly 1400, the tension-roller assembly 1500, the tape-cartridge-actuating assembly 1600, and the wipe-down element 1900 therebetween. As best shown in FIGS. 9A and 9C, the first and second mounting plates M1 and M2 are shaped to define first and second mounting openings M1*o* and M2*o* that are sized, shaped, oriented, positioned, and otherwise configured to enable the tape cartridge 1000 to be pivotably mounted to the base-assembly frame 111 of the base assembly 100, as described in more detail below.

Figure 9D:
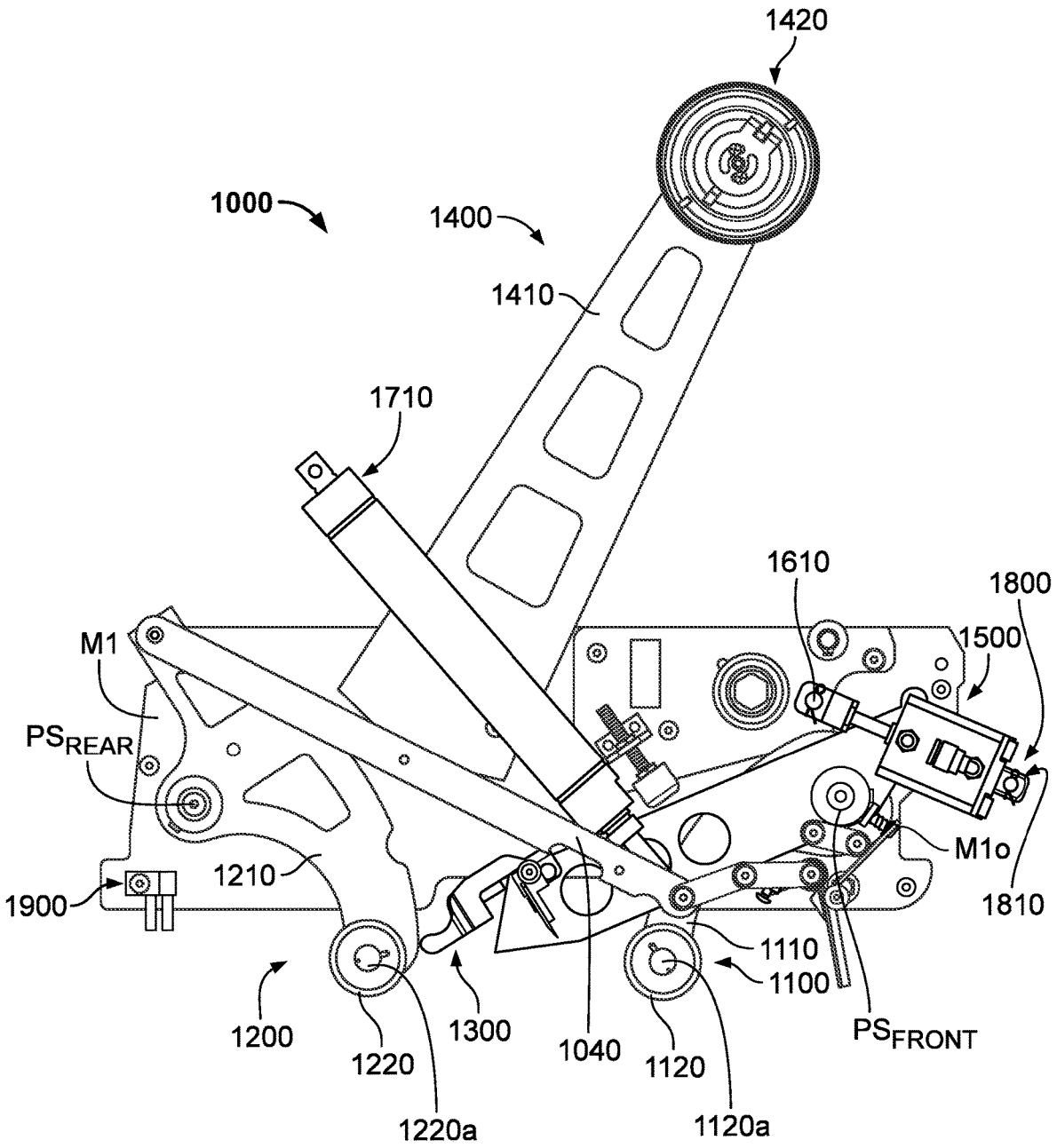

The front roller assembly 1100 includes a front roller arm 1110 and a front roller 1120. The front roller arm 1110 is pivotably mounted to the first mounting plate M1 via a front roller-arm-pivot shaft $PS_{FRONT}$ so the front roller arm 1110 can pivot relative to the mounting plate M1 about an axis between a front roller arm extended position (FIGS. 9A-9C) and a front roller arm retracted position (FIG. 9D). The front roller arm 1110 includes a front roller-mounting shaft 1120*a*, and the front roller 1120 is rotatably mounted to the front roller-mounting shaft 1120*a* so the front roller 1120 can rotate relative to the front roller-mounting shaft 1120*a*.

The rear roller assembly 1200 includes a rear roller arm 1210 and a rear roller 1220. The rear roller arm 1210 is pivotably mounted to the first mounting plate M1 via a rear roller-arm-pivot shaft $PS_{REAR}$ so the rear roller arm 1210 can pivot relative to the mounting plate M1 about an axis A REAR between a rear roller arm extended position (FIGS. 9A-9C) and a rear roller arm retracted position (FIG. 9D). The rear roller arm 1210 includes a rear roller-mounting shaft 1220*a*, and the rear roller 1220 is rotatably mounted to the rear roller-mounting shaft 1220*a* so the rear roller 1220 can rotate relative to the rear roller-mounting shaft 1220*a*.

A rigid first linking member 1020 is attached to and extends between the first roller arm 1110 and the second roller arm 1210. The first linking member 1020 links the front and rear roller assemblies 1100 and 1200 so: (1) moving the front roller arm 1110 from the front roller arm extended position to the front roller arm retracted position causes the first linking member 1020 to force the rear roller arm 1210 to move from the rear roller arm extended position to the rear roller arm retracted position (and vice-versa); and (2) moving the rear roller arm 1210 from the rear roller arm extended position to the rear roller arm retracted position causes the first linking member 1020 to force the front roller arm 1110 to move from the front roller arm extended position to the front roller arm retracted position (and vice-versa).

The tape-cartridge-actuating assembly 1600 (FIG. 2) includes a roller-arm-actuating assembly 1700 and a cutter-arm-actuating assembly 1800.

The roller-arm-actuating assembly 1700 is configured to move the linked front and rear roller arms 1110 and 1210 between their respective extended and retracted positions. As best shown in FIG. 9G, in this example embodiment the roller-arm-actuating assembly 1700 includes a support plate 1702 and a roller-arm actuator 1710 pivotably attached to the support plate 1702 via a pin assembly 1703. The roller-arm actuator 1710 may be any suitable actuator, such as a motor or a pneumatic cylinder fed with pressurized gas and controlled by one or more valves.

The roller-arm actuator 1710 is operably connected to the front roller assembly 1100 to control movement of the front roller arm 1110 and the rear roller arm 1210 linked to the front roller arm 1110 between their respective extended and retracted positions. More specifically, the roller-arm actuator 1710 is coupled between the mounting plate M2 and the first roller arm assembly 1100 via attachment of the support plate 1702 to the mounting plate M2 and attachment of the roller-arm actuator 1710 to the shaft 1130 of the front roller assembly 1100.

The controller 90 is operably connected to the roller-arm actuator 1710 and configured to control the roller-arm actuator 1710 and therefore the positions of the front and rear roller arms 1110 and 1210.

Figure 9E:
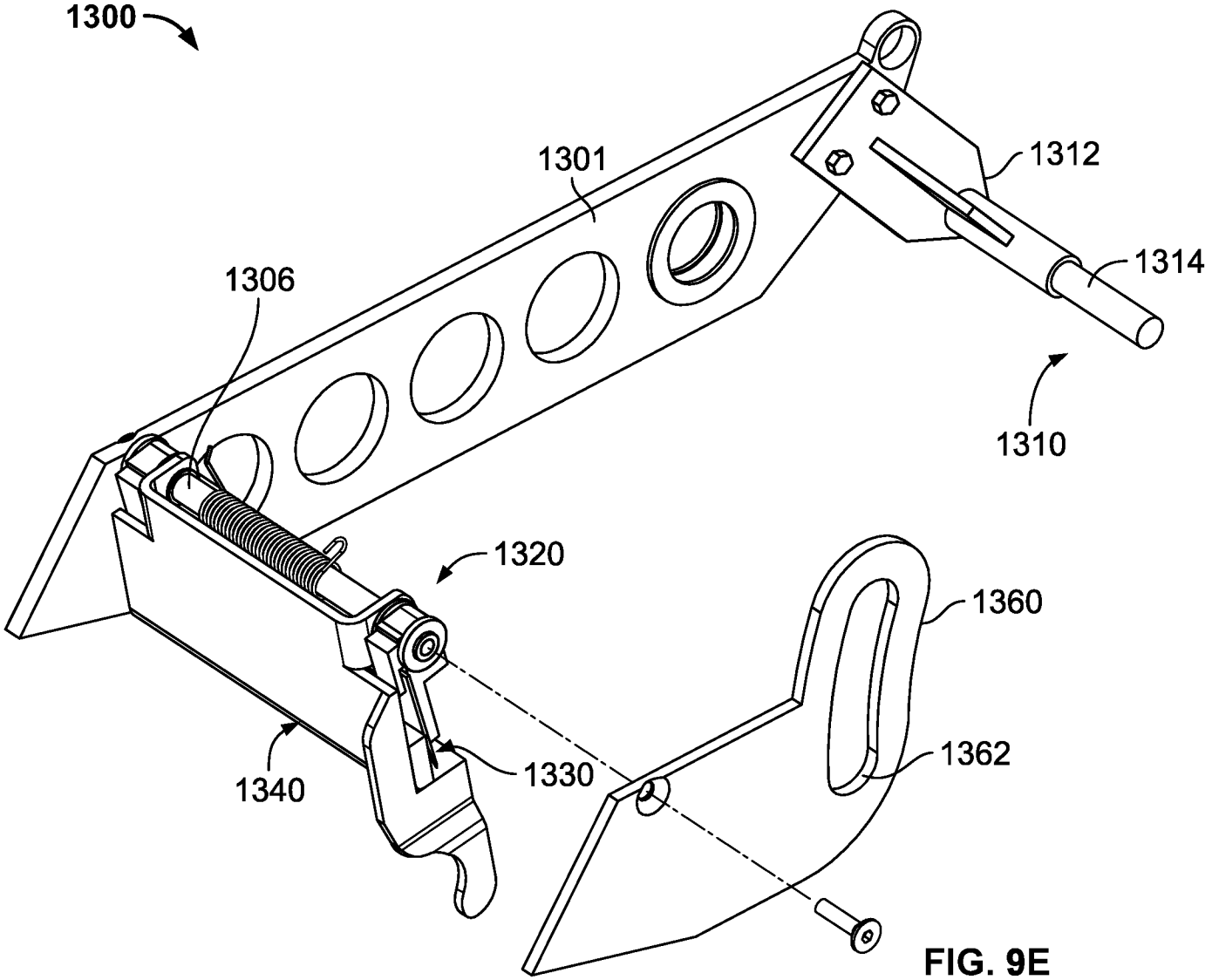
Figure 9F:
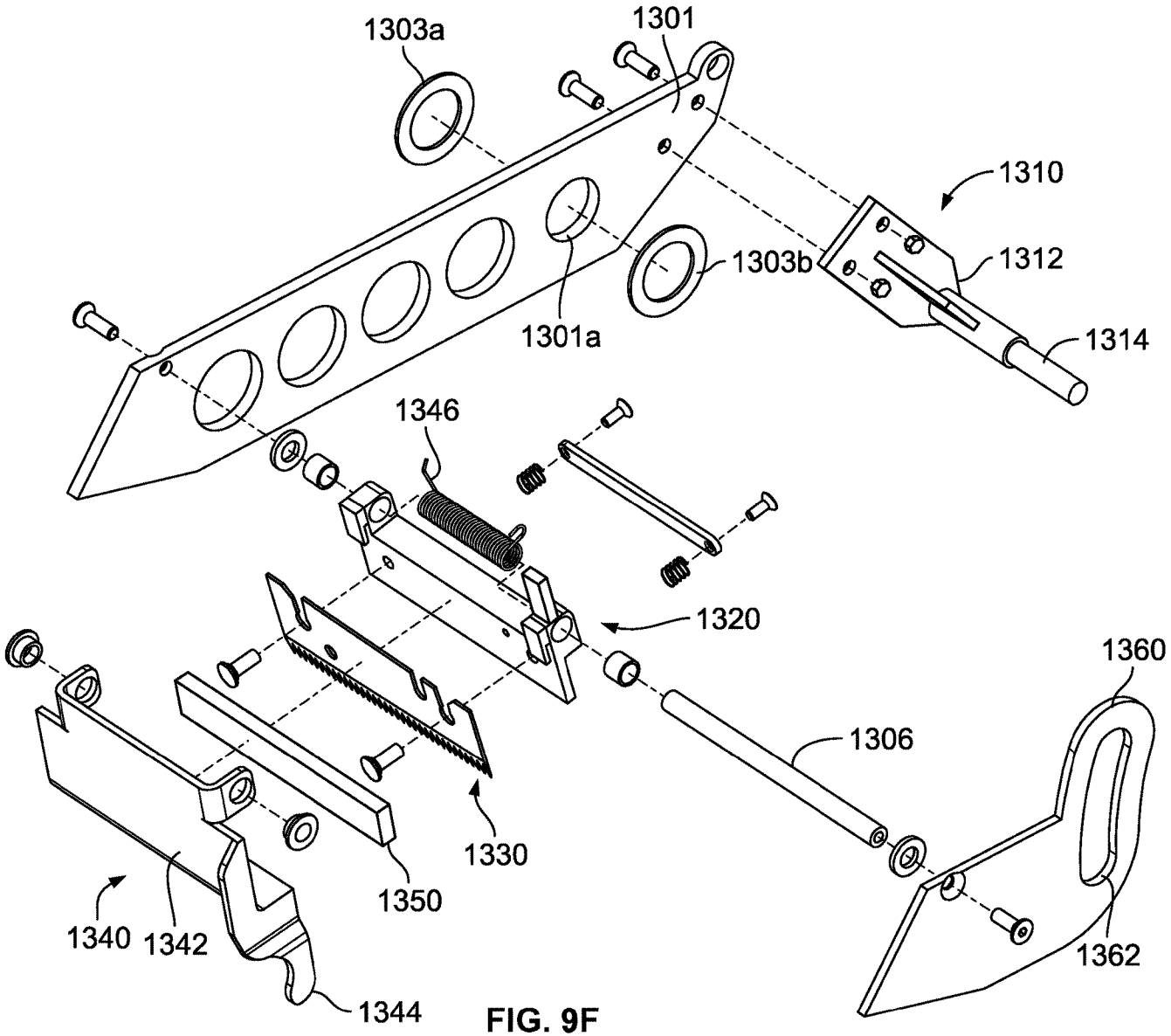

As best shown in FIGS. 9E and 9F, the cutter assembly 1300 includes a cutter arm 1301, a cutting-device cover pivot shaft 1306, a cutter-arm-actuator-coupling element 1310, a cutting-device-mounting assembly 1320, a cutting device 1330 including a toothed blade (not labeled) configured to sever tape, a cutting-device cover 1340, a cutting-device pad 1350, and a rotation-control plate 1360.

The cutter arm 1301 includes a cylindrical surface 1301*a* that defines a cutter arm mounting opening. The cutter arm 1301 is pivotably mounted (via the cutter arm mounting opening) to the first mounting plate M1 via the front roller-arm-pivot shaft $PS_{FRONT}$ and bushings 1303*a* and 1303*b* so the cutter arm 1301 can pivot relative to the mounting plate M1 about the axis between a cutter arm extended position (FIGS. 9A-9C) and a cutter arm retracted position (FIG. 9D).

The cutter-arm-actuator-coupling element 1310 includes a support plate 1312 and a coupling shaft 1314 extending transversely from the support plate 1312. The support plate 1312 is fixedly attached to the cutter arm 1301 via fasteners.

The cutting-device-mounting assembly 1320 is fixedly mounted to the support arm 1301 (such as via welding) and is configured to removably receive the cutting device 1330. That is, the cutting-device-mounting assembly 1320 is configured so the cutting device can be removably mounted to the cutting-device-mounting assembly 1320. The cutting-device-mounting assembly 1320 is described in U.S. Pat. No. 8,079,395, though any other suitable cutting-device-mounting assembly may be used to support the cutting device 1330.

The cutting-device cover 1340 includes a body 1342 and a finger 1344 extending from the body 1342. A pad 1350 is attached to the body 1342. The cutting-device cover 1340 is pivotably mounted to the support arm 1301 via mounting openings (not labeled) and the cutting-device cover pivot shaft 1306. Once attached, the cutting-device cover 1340 is pivotable about an axis relative to the cutter arm 1301 and the cutting-device-mounting assembly 1320 from front to back and back to front between a closed position and an open position. A cutting-device cover biasing element 1346, which includes a torsion spring in this example embodiment, biases the cutting-device cover 1340 to the closed position. When in the closed position, the cutting-device cover 1340 generally encloses the cutting device 1330 so the pad 1350 contacts the toothed blade of the cutting device 1330. When in the open position, the cutting-device cover 1340 exposes the cutting device 1330 and its toothed blade.

The cutting-device cover pivot shaft 1306 is also attached to the rotation-control plate 1360. The rotation-control plate 1360 includes a slot-defining surface 1362 that defines a slot. The surface 1362 acts as a guide (not shown) for a bushing that is attached to the mounting plate M2. The bushing provides lateral support for the cutter assembly 1300 to generally prevent the cutter assembly 1300 from moving toward or away from the mounting plates M1 and M2 and interfering with other components of the tape cartridge 1000 when in use.

Figure 9H:
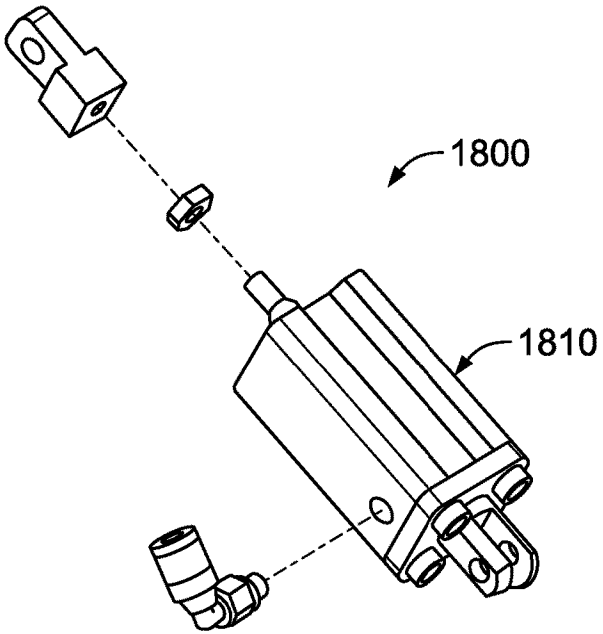
Figure 9G:
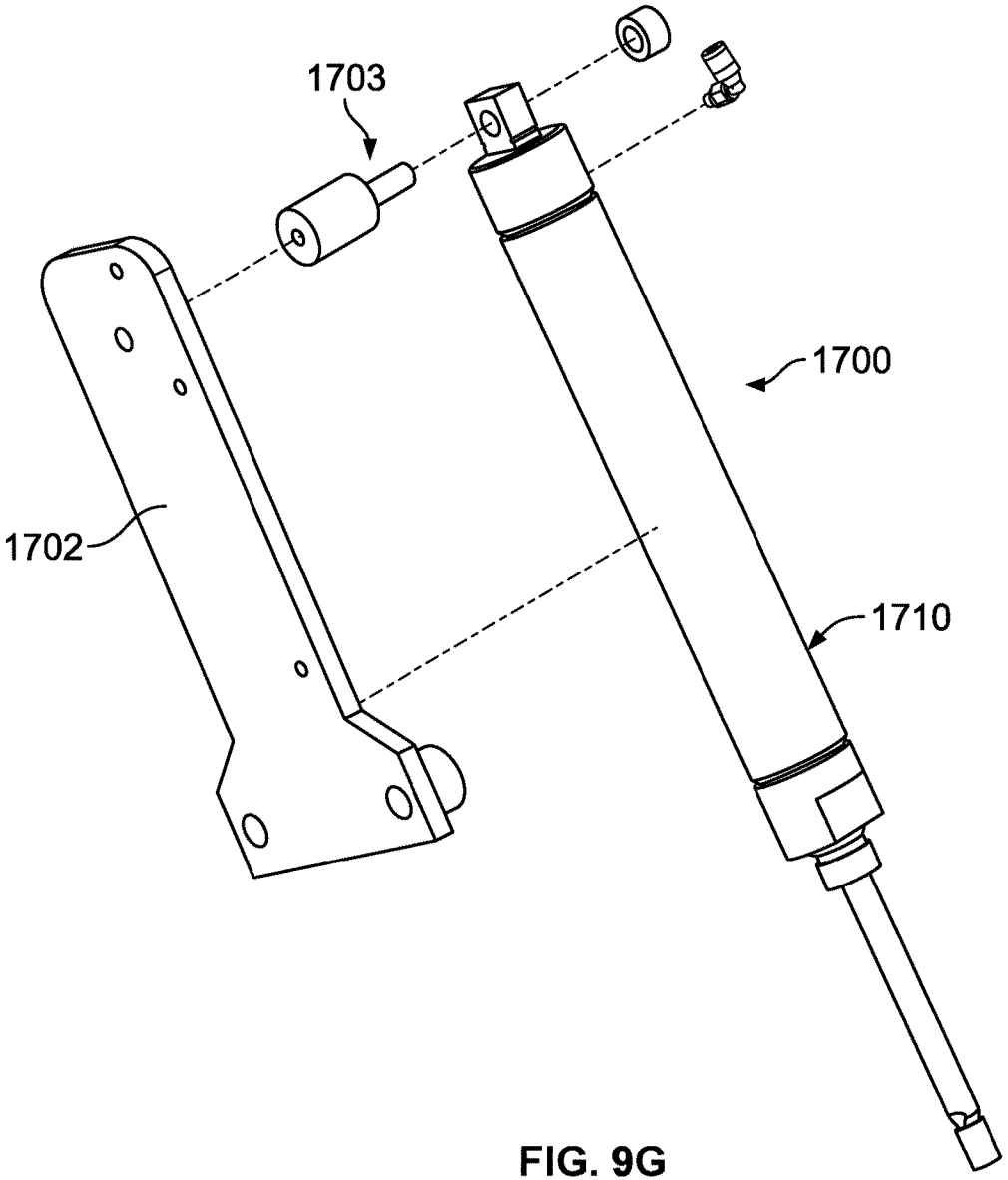

The cutter-arm-actuating assembly 1800 is configured to move the cutter arm 1301 between its retracted position and its extended position. As best shown in FIG. 9H, in this example embodiment the cutter-arm-actuating assembly 1800 includes a cutter-arm actuator 1810. The cutter-arm actuator 1810 may be any suitable actuator, such as a motor or a pneumatic cylinder fed with pressurized gas and controlled by one or more valves.

The cutter-arm actuator 1810 is operably connected to the cutter assembly 1300 to control movement of the cutter arm 1301 from its retracted position to its extended position. More specifically, the cutter-arm actuator 1810 is coupled between the mounting plate M1 and the cutter assembly 1300 via attachment to the shaft 1610 and to the coupling shaft 1314 of the cutter-arm-actuator-coupling element 1310.

The controller 90 is operably connected to the cutter-arm actuator 1810 and configured to control the cutter-arm actuator 1810 and therefore the position of the cutter arm 1301.

The tape-mounting assembly 1400 includes a tape-mounting plate 1410 and a tape-core-mounting assembly 1420 rotatably mounted to the tape-mounting plate 1410. The tape-core-mounting assembly 1420 is further described in U.S. Pat. No. 7,819,357, the entire contents of which are incorporated herein by reference (though other tape core mounting assemblies may be used in other embodiments). A roll R of tape is mountable to the tape-core-mounting assembly 1420.

The tension-roller assembly 1500 includes several rollers (not labeled) rotatably disposed on shafts that are supported by the first mounting plate M1. A free end of the roll R of tape mounted to the tape-core-mounting assembly 1420 is threadable through the rollers until the free end is adjacent the front roller 1120 of the front-roller assembly 1100 with its adhesive side facing outward in preparation for adhesion to a case. The tension-roller assembly 1500 is further described in U.S. Pat. No. 7,937,905 (though other tension roller assemblies may be used in other embodiments).

The wipe-down element 1900 includes a base 1910 and one or more deformable elements 1920 connected to the base 1910. The base 1910 is fixedly mounted to and extends between the first and second mounting plates M1 and M2 downstream of the rear roller assembly 1200. The wipe-down element 1900 is oriented so the deformable elements 1920 extend toward the roller 1220 when the rear roller arm 1210 is in the rear-roller-arm extended position. The deformable elements 1920 are rigid enough to return to their original shape when no force is applied to them yet compliant enough to deform when sufficient force is applied to them, such as when a case is forced against them as described below. In this example embodiment, the deformable elements 1920 are bristles, though they may be any suitable elements in other embodiments (such as foam or rubber elements).

Figure 4:
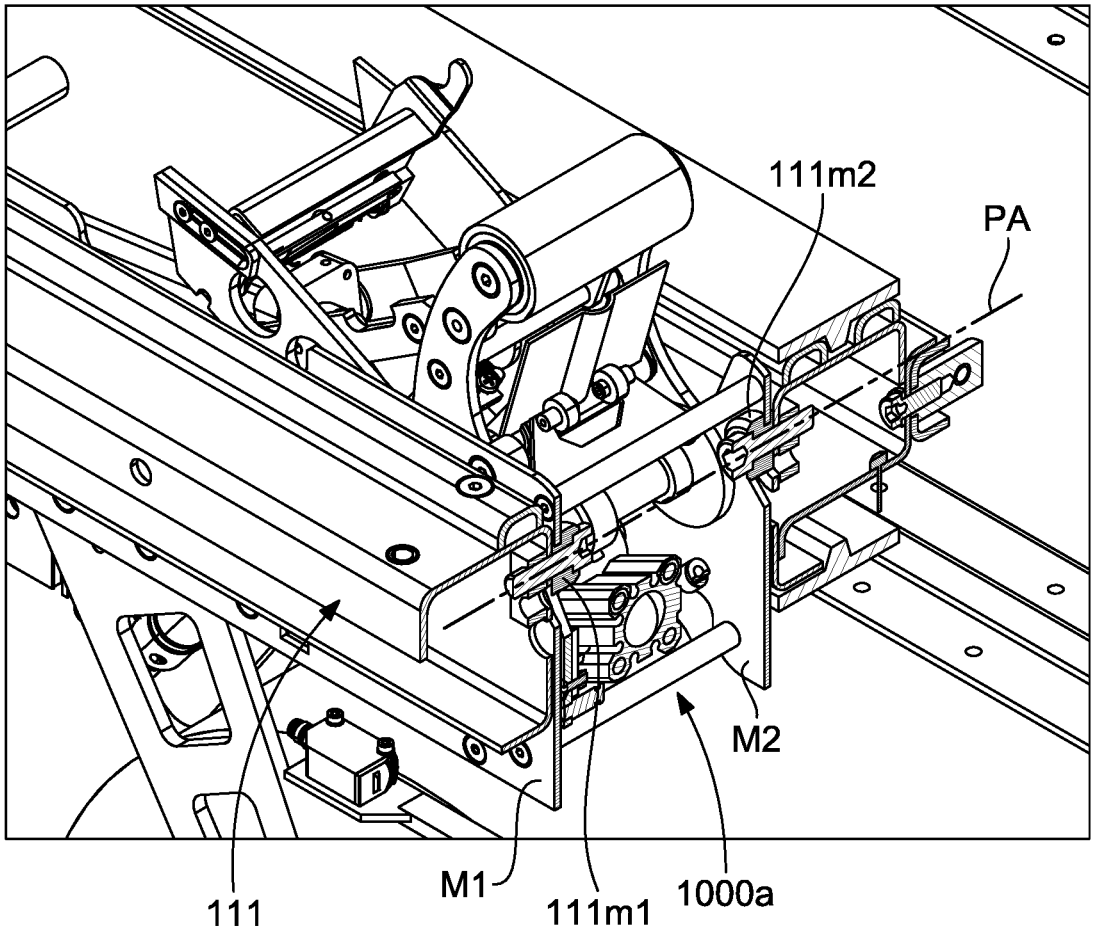
FIG. 4 is a cross-sectional perspective view of part of the base assembly and the lower tape cartridge of the case sealer of FIG. 1.
Figure 5:
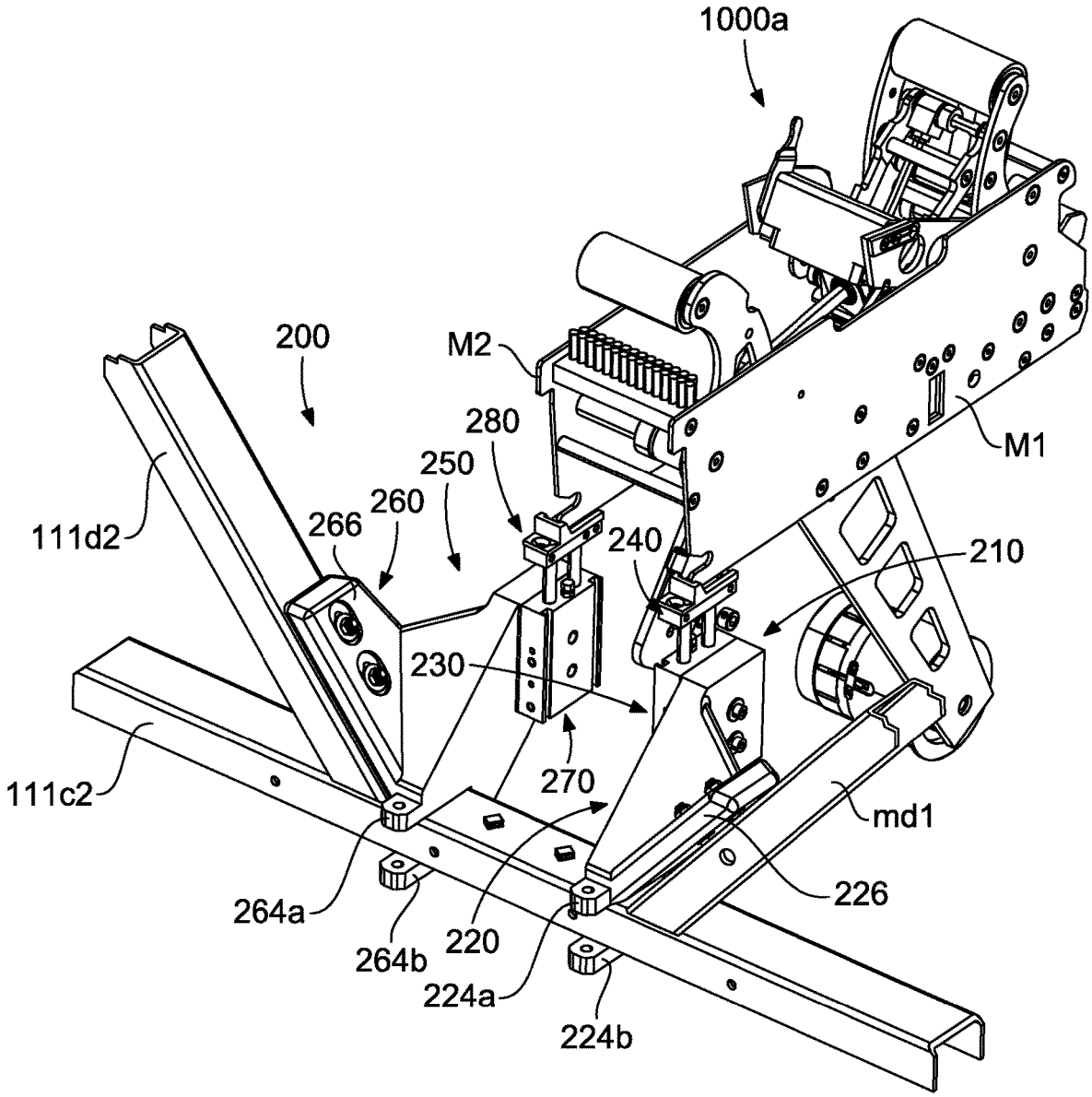
FIG. 5 is a perspective view of part of the base assembly, the tape-cartridge-mover assembly, and the lower tape cartridge of the case sealer of FIG. 1.

The lower tape cartridge 1000*a* is movably (here, pivotably) and removably mounted to the base assembly 100 and configured to apply tape to the leading surface, the bottom surface, and the trailing surface of the case. As best shown in FIG. 4, the lower tape cartridge 1000*a* is positioned and oriented so two opposing tape-cartridge mounts 111*m*1 and 111*m*2 attached to the base-assembly frame 111 are received in the first and second mounting openings M1*o* and M2*o*, respectively, of the first and second mounting plates M1 and M2 of the lower tape cartridge 1000*a*. As best shown in FIG. 5, the lower tape cartridge 1000*a* is also positioned and oriented so the opposite end of the first mounting plate M1 is received on and supported by the base 242 of the first tape-cartridge support 240 of the tape-cartridge-mover assembly 200 between the lips 242*a* and 242*b* and the opposite end of the second mounting plate M2 is received on and supported by the base 282 of the second tape-cartridge support 280 of the tape-cartridge-mover assembly 200 between the lips 282*a* and 282*b*. In other embodiments, the tape cartridge is configured to be releasingly engaged by one or more of the tape-cartridge supports.

Figure 10A:
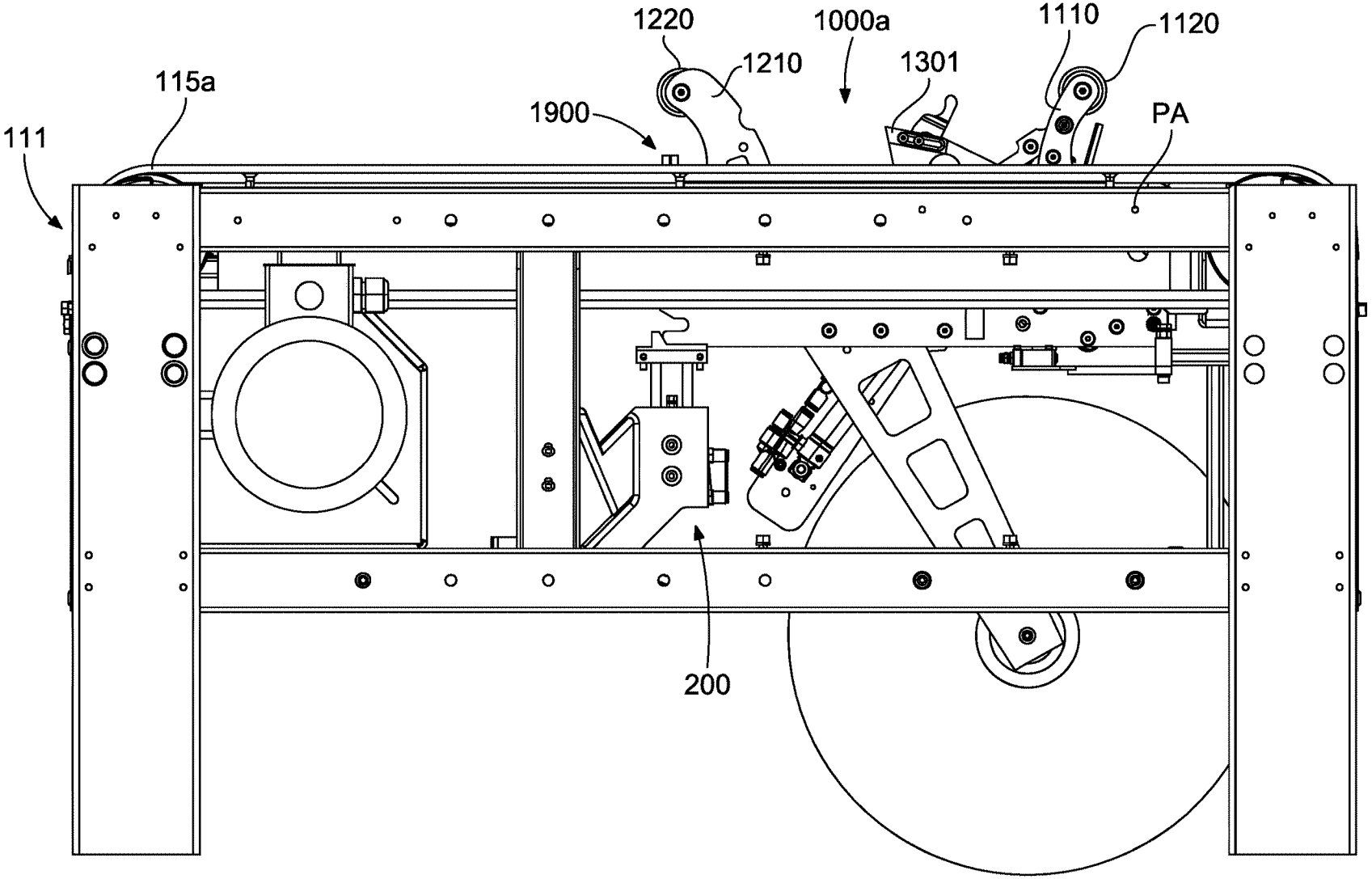
FIG. 10A is a side view of part of the case sealer of FIG. 1 with the lower tape cartridge in a home position and the roller arms and the cutter arm of the lower tape cartridge in respective extended positions.
Figure 10B:
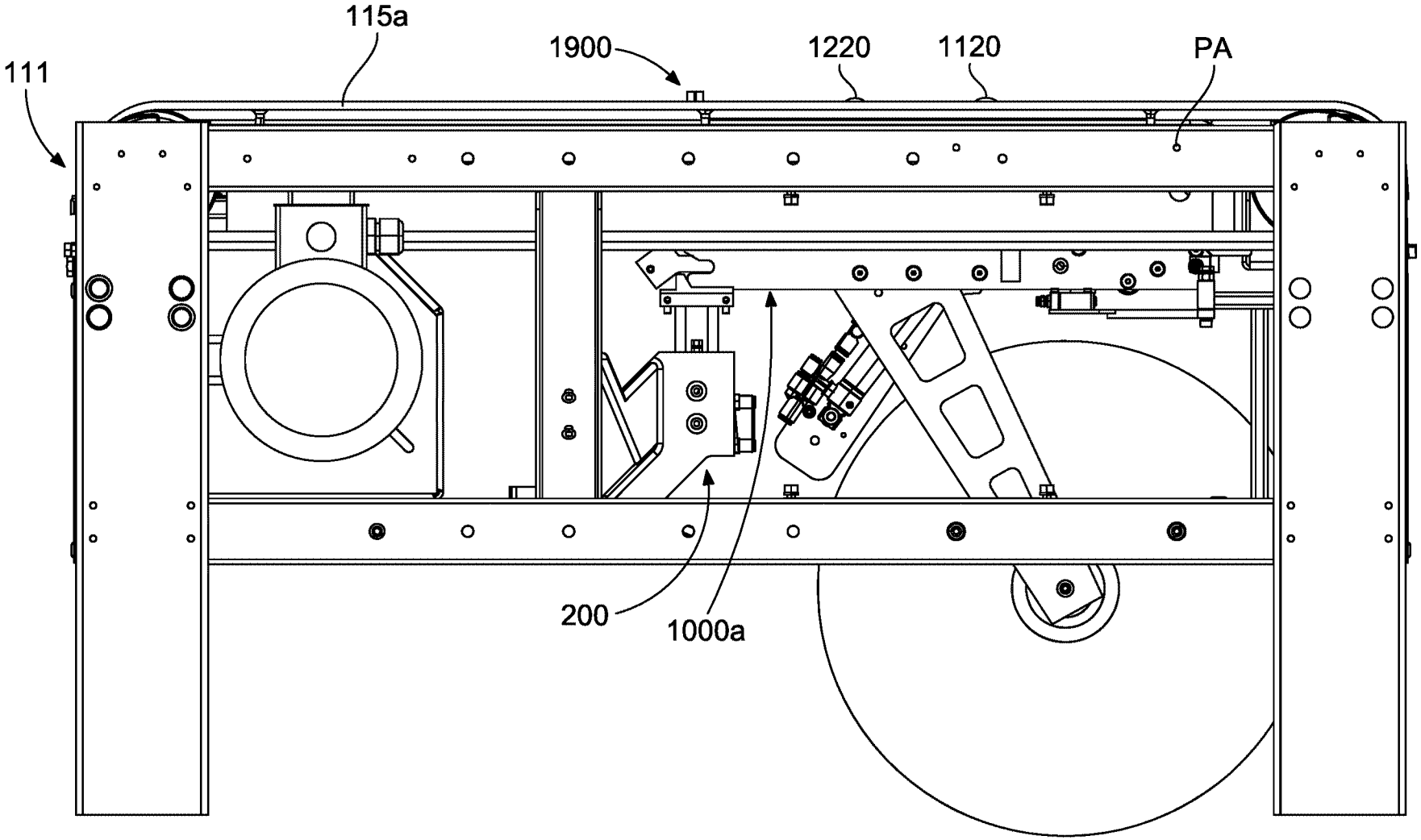
FIG. 10B is a side view of part of the case sealer of FIG. 1 with the lower tape cartridge in a home position and the roller arms and the cutter arm of the lower tape cartridge in retracted positions.
Figure 10C:
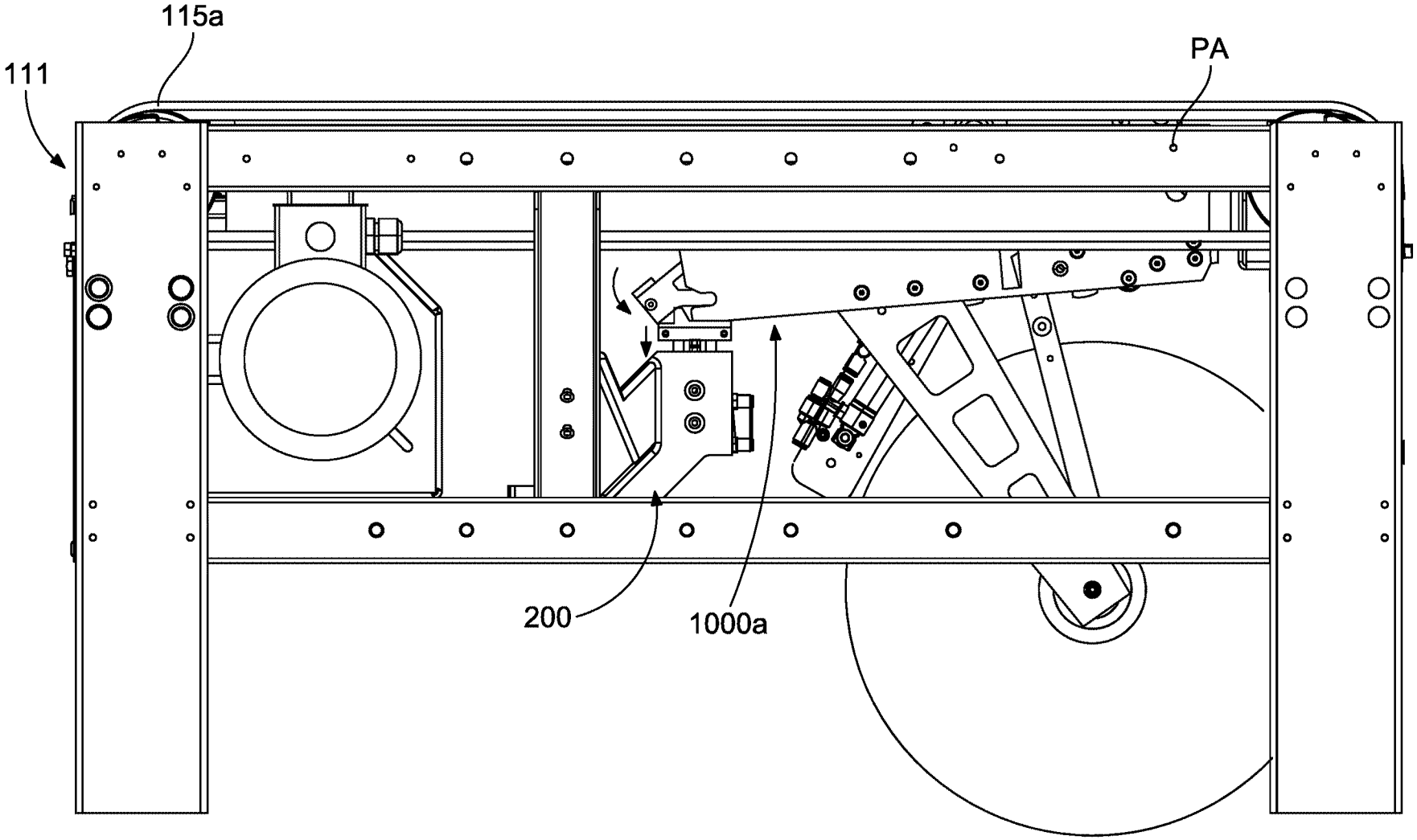
FIG. 10C is a side view of part of the case sealer of FIG. 1 with the lower tape cartridge in a bypass position and the roller arms and the cutter arm of the lower tape cartridge in retracted positions.

This mounting configuration results in the lower tape cartridge 1000*a* being pivotable relative to the base assembly 100 and the tape-cartridge-mover assembly 200 about a pivot axis PA defined by the tape-cartridge mounts 111*m*1 and 111*m*2 between a home position shown in FIGS. 10A and 10B and a bypass position shown in FIG. 10C (though the pivot axis PA may be positioned in other locations as well). The lower tape cartridge 1000*a* is in its home position when the first and second tape-cartridge supports 240 and 280 are in their respective home positions and in its bypass position when the first and second tape-cartridge supports 240 and 280 are in their respective bypass positions. Accordingly, in this example embodiment, the first and second tape-cartridge-mover actuators 230 and 270 are operably connected to the lower tape cartridge 1000*a* via the first and second tape-cartridge supports 240 and 280 and configured to move the lower tape cartridge 1000*a* between its home and bypass positions. In this example embodiment, the first and second tape-cartridge-mover actuators 230 and 270 are configured to actively move the lower tape cartridge 1000*a* between its home and bypass positions. In other embodiments, the lower tape cartridge 1000*a* is biased by one or more springs or other suitable biasing elements to its home or bypass position, and the first and second tape-cartridge-mover actuators 230 and 270 are configured to move the lower tape cartridge 1000*a* to the other of the home and bypass position against the force of the biasing element.

FIG. 10A shows the lower tape cartridge 1000*a* is in its home position and the front roller arm 1110, the rear roller arm 1210, and the cutter arm 1301 of the lower tape cartridge 1000*a* in their respective extended positions. In this configuration, the front and rear rollers 1120 and 1220 are at least partially—and in this example embodiment are entirely—positioned above the upper surfaces of the first and second lower drive elements 115*a* and 115*b*. Additionally, the wipe-down element 1900 extends above the upper surfaces of the first and second lower drive elements 115*a* and 115*b*. FIG. 10B shows the lower tape cartridge is in its home position and the front roller arm 1110, the rear roller arm 1210, and the cutter arm 1301 of the lower tape cartridge 1000*a* in their respective retracted positions. In this configuration, part of the front and rear rollers 1120 and 1220 are positioned above the upper surfaces of the first and second lower drive elements 115*a* and 115*b*. Additionally, the wipe-down element 1900 extends above the upper surfaces of the first and second lower drive elements 115*a* and 115*b*. The positions of the front and rear rollers 1120 and 1220 and the wipe-down element 1900 in these configurations enable tape to be applied to a case during a case-sealing process.

FIG. 10C shows the lower tape cartridge 1000*a* in its bypass position and the front roller arm 1110, the rear roller arm 1210, and the cutter arm 1301 of the lower tape cartridge 1000*a* in their respective retracted positions. In this configuration, the front and rear rollers 1120 and 1220 and the wipe-down element 1900 are not above the upper surfaces of the first and second lower drive elements 115*a* and 115*b*. This prevents these components from interfering with a case—such as by impeding its movement or inadvertently applying tape to the case—during a case-bypass process (explained below).

The upper tape cartridge 1000*b* is removably mounted to the top head assembly 400 in any suitable manner and is configured to apply tape to a leading surface, a top surface, and a trailing surface of a case.

Operation of the case sealer 10 to seal a case during a case-sealing process is now described. Initially, the top-head assembly 400 is at its initial (lower) position; the side rails 114*a* and 114*b* are in their rest configuration; the lower tape cartridge 1000*a* is in its home position; the front roller arm 1110, the rear roller arm 1210, and the cutter arm 1301 of the lower tape cartridge 1000*a* are in their respective extended positions; and the front roller arm 1110, the rear roller arm 1210, and the cutter arm 1301 of the upper tape cartridge 1000*b* are in their respective extended positions. The controller 90 controls the lower-drive-assembly actuator 118 and the upper-drive-assembly actuator 422 to drive the first and second lower drive elements 115*a* and 115*b* of the base assembly 100 and the upper drive element of the top-head assembly 400, respectively.

The operator positions the case on the infeed table 112. The infeed-table sensor S1 detects the presence of the case and in response sends a corresponding case-detected signal to the controller 90. Responsive to receiving that case-detected signal, the controller 90 controls the side-rail actuator 117 to move the side rails 114*a* and 114*b* from the rest configuration to the centering configuration so the side rails 114*a* and 114*b* move laterally inward to engage and center the case on the infeed table 112.

The operator then moves the case into contact with the leading-surface sensor S2. This causes the leading-surface sensor S2 (via the case contacting and actuating the paddle switch of the leading-surface sensor S2) to detect the case and in response send a corresponding case-detected signal to the controller 90. Responsive to receiving the case-detected signal, the controller 90 controls the top-head-actuating assembly 305 (and, more particularly, the top-head-actuating-assembly actuator(s) 310) to begin raising the top-head assembly 400. As the top-head assembly 400 moves upward, the leading-surface sensor S2 eventually stops detecting the case. This indicates that the top-head assembly 400 has ascended above the top surface of the case. In response to no longer detecting the case, the leading-surface sensor S2 sends a corresponding case-undetected signal to the controller 90. Responsive to receiving that signal, the controller 90 controls the top-head-actuating assembly 305 (and more particularly the top-head-actuating-assembly actuator(s) 310) to enable the top-head assembly 400 to stop its ascent and begin descending.

Once the top-head assembly 400 ascends above the top surface of the case, the operator moves the case to a holding position partially beneath the top-head assembly 400 and atop the first and second lower drive elements 115*a* and 115*b*, at which point the operator stops moving the case. As the case moves beneath the top-head assembly 400 and toward the holding position, the case-entry sensor S3 detects the presence of the case beneath the top-head assembly and in response sends a corresponding case-detected signal to the controller 90. Shortly thereafter, the upper drive element of the upper drive assembly of the top-head assembly 400 engages the top surface of the case and joins the first and second lower drive elements in moving the case in the direction D.

The controller 90 receives a case-detected signal from the arm-retraction sensor S4 (indicating that the arm-retraction sensor S4 detected the case) and in response controls the roller-arm actuators 1710 and the cutter-arm actuators 1810 of the lower and upper tape cartridges 1000*a* and 1000*b* to move their respective first and second roller arms 1110 and 1120 and cutter arms 1301 to their retracted positions. The leading surface of the case contacts the front rollers 1120 as the front roller arms 1110 are moving to their retracted positions, which causes the tape positioned on the front rollers 1120 to adhere to the leading surface of the case. When the front and rear roller arms 1110 and 1210 are in their retracted positions, the front and rear rollers 1120 and 1220 are positioned to apply enough pressure to the tape to adhere the tape to the top and bottom surfaces of the case. When the cutter arms 1301 are in their retracted positions, the cutter arms 1301 do not contact the top or bottom surfaces of the case (though in certain embodiments they may do so). The controller 90 controls the roller-arm actuators 1710 and the cutter-arm actuators 1810 to retain the front and rear roller arms 1110 and 1210 and the cutter arms 1301 in their respective retracted positions as the upper and lower drive assemblies 320 and 115 move the case past the tape cartridges 1000*a* and 1000*b*.

The case eventually moves off of the infeed table 112, at which point the infeed-table sensor S1 stops detecting the case and sends a corresponding case-undetected signal to the controller 90. Responsive to receiving that case-undetected signal, the controller 90 controls the side-rail actuator 117 to move the side rails 114*a* and 114*b* from the centering configuration to the rest configuration to make space on the infeed table 112 for the next case.

At some point, the case-exit sensor S5 detects the presence of the case (though this may occur after the arm-retraction sensor S4 stops detecting the case depending on the length of the case) and sends a corresponding case-detected signal to the controller 90.

Once the arm-retraction sensor S4 stops detecting the case (indicating that the case has moved past the arm-retraction sensor S4), the arm-retraction sensor S4 sends a corresponding case-undetected signal to the controller 90. In response, the controller 90 controls the roller-arm actuators 1710 of the tape cartridges 1000*a* and 1000*b* to return the first and second roller arms 1110 and 1120 to their respective extended positions to apply tape to the trailing surface of the case and controls the cutter-arm actuators 1810 of the tape cartridges 1000*a* and 1000*b* to return the cutter arms 1301 to their extended positions to cut the tape from the rolls. As this occurs, the fingers 1344 of the cutting-device covers 1340 contact the top and bottom surfaces of the case so the cutting-device covers 1340 pivots to their open positions and expose the cutting devices 1330. Continued movement of the cutter arms 1301 brings the toothed blades of the cutting devices 1330 into contact with the tape and severs the tape from the respective rolls R. As the front and rear roller arms 1110 and 1210 move back to their extended positions, the rear roller arms 1210 move so the rear rollers 1220 contact the severed ends of the tape and apply the tape to the trailing surface of the case to complete the taping process.

The upper and lower drive assemblies 420 and 115 continue to move the case until it exits from beneath the top-head assembly 400 onto the outfeed table 113, at which point the case-exit sensor S5 stops detecting the case and sends a corresponding case-undetected signal to the controller 90. The top-head assembly 400 then descends back to its initial position.

In certain scenarios, such as when an incoming case has already been sealed, the operator does not want the case sealer 10 to apply tape to the case. In these instances, a case-bypass process is carried out by the case sealer to move the case through the case sealer without applying tape to the case and without impeding the case's movement through the case sealer. Operation of the case sealer 10 during the case-bypass process is now described. Initially, the top-head assembly 400 is at its initial (lower) position; the side rails 114*a* and 114*b* are in their rest configuration; the lower tape cartridge 1000*a* is in its home position; the front roller arm 1110, the rear roller arm 1210, and the cutter arm 1301 of the lower tape cartridge 1000*a* are in their respective extended positions; and the front roller arm 1110, the rear roller arm 1210, and the cutter arm 1301 of the upper tape cartridge 1000*b* are in their respective extended positions. The controller 90 controls the lower-drive-assembly actuator 118 and the upper-drive-assembly actuator 422 to drive the first and second lower drive elements 115*a* and 115*b* of the base assembly 100 and the upper drive element of the top-head assembly 400, respectively.

The operator positions the case onto the infeed table 112. The infeed-table sensor S1 detects the presence of the case and in response sends a corresponding case-detected signal to the controller 90. Responsive to receiving that case-detected signal, the controller 90 controls the side-rail actuator 117 to move the side rails 114*a* and 114*b* from the rest configuration to the centering configuration so the side rails 114*a* and 114*b* move laterally inward to engage and center the case on the infeed table 112.

The case-bypass process begins responsive to a case-bypass condition being met. In this example embodiment, the case-bypass condition is met when the bypass actuator 190 is actuated. The case-bypass condition may be met in any suitable manner in other embodiments. For instance, in certain embodiments, the case-bypass condition is met when the controller 90 receives a signal (such as from another device of a packaging line) indicating that the incoming case does not need to be sealed. Here, when the operator actuates the bypass actuator 190, it sends a corresponding signal to the controller 90. Responsive to receiving the signal from the bypass actuator 190, the controller 90 switches the case sealer 10 into its bypass configuration by: (1) controlling the top-head-actuating assembly 305 (and, more particularly, the top-head-actuating-assembly actuator(s) 310) to begin raising the top-head assembly 400 to a bypass position (which in this example embodiment is the uppermost position of the top-head assembly 400); (2) controlling the roller-arm actuators 1710 and the cutter-arm actuators 1810 of the lower and upper tape cartridges 1000*a* and 1000*b* to move their respective first and second roller arms 1110 and 1120 and cutter arms 1301 to their retracted positions (in other embodiments, this occurs for the lower tape cartridge and not the upper tape cartridge); and (3) controlling the first and second tape-cartridge-mover actuators 230 and 270 to move the lower tape cartridge 1000*a* to its bypass position.

Once the top-head assembly 400 ascends above the top surface of the case, the operator moves the case onto the first and second lower drive elements 115*a* and 115*b*, which move the case in the direction D and onto the outfeed table 13. Since the roller and cutter arms of the tape cartridges 1000*a* and 1000*b* are in their retracted positions and the lower tape cartridge 1000*a* is in its bypass position, neither the rollers on the roller arms nor the wipe-down devices interfere with the case or impede its progress through the case sealer 10. At some point, the case-exit sensor S5 detects the presence of the case and sends a corresponding case-detected signal to the controller 90. The lower drive assembly 115 continues to move the case until it exits onto the outfeed table 113, at which point the case-exit sensor S5 stops detecting the case and sends a corresponding case-undetected signal to the controller 90. In response, the controller 90: (1) controls the top-head-actuating assembly 305 (and, more particularly, the top-head-actuating-assembly actuator(s) 310) to lower the top-head assembly 400 to its initial position; (2) controls the roller-arm actuators 1710 and the cutter-arm actuators 1810 of the lower and upper tape cartridges 1000*a* and 1000*b* to move their respective first and second roller arms 1110 and 1120 and cutter arms 1301 to their extended positions; and (3) controls the first and second tape-cartridge-mover actuators 230 and 270 to move the lower tape cartridge 1000*a* to its home position.

In some embodiments, the tape cartridge includes biasing elements that bias the roller arms and the cutter arm to their respective extended positions. The biasing elements eliminate the need for direct actuation of the roller arms and the cutter arm from their respective retracted positions to their respective extended positions.

In certain embodiments, the controller is separate from and in addition to the sensors. In other embodiments, the sensors act as their own controllers. For instance, in one embodiment, the retraction sensor is configured to directly control the cutter and roller arm actuators responsive to detecting the presence of and the absence of the case, the infeed-table sensor is configured to directly control the side rail actuator responsive to detecting the presence of and the absence of the case, and the leading-surface and top-surface sensors are configured to directly control the top head actuator responsive to detecting the presence of and the absence of the case (or contact with the case).

In the illustrated and above-described embodiment, the tape cartridge is pivotable relative to the base-assembly frame to its bypass position. In other embodiments, the tape cartridge is translatable (in addition to or instead of being pivotable) relative to the base-assembly frame to its bypass position. For instance, one or more tape-cartridge-mover actuators are operably connected to the tape cartridge and configured to lower the entire tape cartridge relative to the lower drive element(s) to its bypass position.

In the illustrated and above-described embodiment, the case sealer is in its bypass configuration when the roller arms and the cutter arm of the lower tape cartridge are in their retracted positions and when the tape cartridge is in its bypass position. In other embodiments, the bypass position of the tape cartridge is configured so the rollers of the tape cartridge are not above the upper surface of the lower drive element(s) when the tape cartridge is in the bypass position and the roller arms and the cutter arm are in their extended positions.

In the illustrated and above-described embodiment, the lower drive element(s) are not vertically movable relative to the tape cartridge, and the tape cartridge must move to its bypass position and retract its roller and cutter arms so the rollers of the tape cartridge do not extend above the upper surface of the lower drive element. In other embodiments, the lower drive elements are reconfigurable in addition to or instead of moving the tape cartridge and/or retracting its roller and cutter arms so the rollers of the tape cartridge do not extend above the upper surface of the lower drive element. For instance, in certain such embodiments, the case sealer includes an actuator operably connected to the lower drive elements and configured to raise the lower drive elements relative to the tape cartridge and into bypass positions. In these embodiments, when the lower drive elements are in their bypass positions and the roller and cutter arms of the tape cartridge are in their retracted positions, the rollers of the tape cartridge are not above the upper surface of the lower drive element.

The invention claimed is:

1. A case sealer comprising:

a frame;

a lower drive element supported by the frame;

a lower-drive-element actuator operably connected to the lower drive element and configured to drive the lower drive element;

a tape cartridge comprising a mounting plate, a roller arm supported by the mounting plate, and a roller supported by the roller arm, wherein the tape cartridge is supported by the frame and movable relative to the lower drive element between a home position and a bypass position, wherein when the tape cartridge is in the home position, the roller is positioned to engage a leading surface of a case as the lower drive element moves the case toward the tape cartridge; and a tape-cartridge mover operably connected to the tape cartridge and configured to move the mounting plate and the roller arm relative to the frame such that the tape cartridge moves from the home position to the bypass position to lower the roller.

2. The case sealer of claim 1, wherein the roller is at least partially above an upper surface of the lower drive element when the tape cartridge is in the home position, wherein the roller is not above the upper surface of the lower drive element when the tape cartridge is in the bypass position.

3. The case sealer of claim 1, wherein the tape cartridge further comprises a roller-arm actuator operably coupled to the roller arm and configured to move the roller arm relative to the mounting plate from an extended position to a retracted position to lower the roller.

4. The case sealer of claim 3, wherein the tape cartridge further comprises a biasing element configured to bias the roller arm to the extended position.

5. The case sealer of claim 3, wherein the roller is at least partially above an upper surface of the lower drive element when the tape cartridge is in the home position and the roller arm is in the extended position, wherein the roller is at least partially above the upper surface of the lower drive element when the tape cartridge is in the home position and the roller arm is in the retracted position, wherein the roller is not above the upper surface of the lower drive element when the tape cartridge is in the bypass position and the roller arm is in the retracted position.

6. The case sealer of claim 5, wherein an entirety of the roller is above the upper surface of the lower drive element when the tape cartridge is in the home position and the roller arm is in the extended position, wherein part of the roller is above the upper surface of the lower drive element when the tape cartridge is in the home position and the roller arm is in the retracted position.

7. The case sealer of claim 3, further comprising a controller configured to, responsive to a case-bypass condition being met:

control the roller-arm actuator to move the roller arm from the extended position to the retracted position; and control the tape-cartridge mover to move the tape cartridge from the home position to the bypass position.

8. The case sealer of claim 7, wherein the roller is at least partially above an upper surface of the lower drive element when the tape cartridge is in the home position and the roller arm is in the extended position, wherein the roller is at least partially above the upper surface of the lower drive element when the tape cartridge is in the home position and the roller arm is in the retracted position, wherein the roller is not above the upper surface of the lower drive element when the tape cartridge is in the bypass position and the roller arm is in the retracted position.

9. The case sealer of claim 7, wherein the tape-cartridge mover comprises a first tape-cartridge-mover actuator comprising a first pneumatic cylinder, the roller-arm actuator comprises a second pneumatic cylinder, and the lower drive element comprises an endless belt.

10. The case sealer of claim 7, wherein the case-bypass condition is met responsive to an actuation of a bypass actuator.

11. The case sealer of claim 7, further comprising a top-head assembly and a top-head-assembly actuator operably connected to the top-head assembly to move the top-head assembly relative to the frame, wherein the controller is further configured to, responsive to the case-bypass condition being met, control the top-head-assembly actuator to raise the top-head assembly.

12. The case sealer of claim 1, wherein the tape cartridge is pivotably mounted to the frame such that the mounting plate and the roller arm pivot downward when the tape cartridge moves from the home position to the bypass position.

13. The case sealer of claim 12, wherein an upstream end of the mounting plate is mounted to the frame so that a downstream end of the mounting plate descends as the tape cartridge moves from the home position to the bypass position.

14. A method of operating a case sealer to move a case past a tape cartridge of the case sealer without applying tape to the case, the method comprising:

providing the case sealer in a home configuration in which the tape cartridge is in a home position in which a roller of the tape cartridge is positioned to engage a leading surface of the case as a lower drive element of the case sealer moves the case toward the tape cartridge, wherein the tape cartridge further comprises a mounting plate and a roller arm supported by the mounting plate, wherein the roller arm supports the roller;

responsive to a case-bypass condition being met, switching the case sealer from the home configuration into a bypass configuration to move the mounting plate and the roller arm such that the tape cartridge moves from the home position to a bypass position to lower the roller; and actuating the lower drive element to move the case past the tape cartridge when the case sealer is in the bypass configuration such that the tape cartridge does not apply tape to the case.

15. The method of claim 14, wherein switching the case sealer into the bypass configuration comprises actuating a tape-cartridge mover of the case sealer to move the tape cartridge from the home position to the bypass position to lower the roller of the tape cartridge, wherein the roller is at least partially positioned above an upper surface of the lower drive element when the tape cartridge is in the home position and is not above the upper surface of the lower drive element when the tape cartridge is in the bypass position.

16. The method of claim 15, further comprising, responsive to the case-bypass condition being met, actuating a roller-arm actuator of the tape cartridge to move the roller arm relative to the mounting plate from an extended position to a retracted position to lower the roller.

17. The method of claim 16, wherein the roller is at least partially above the upper surface of the lower drive element when the tape cartridge is in the home position and the roller arm is in the extended position, wherein the roller is at least partially above the upper surface of the lower drive element when the tape cartridge is in the home position and the roller arm is in the retracted position, wherein the roller is not above the upper surface of the lower drive element when the tape cartridge is in the bypass position and the roller arm is in the retracted position.

18. The method of claim 17, wherein an entirety of the roller is above the upper surface of the lower drive element when the tape cartridge is in the home position and the roller arm is in the extended position, wherein part of the roller is above the upper surface of the lower drive element when the tape cartridge is in the home position and the roller arm is in the retracted position.

19. The method of claim 15, wherein actuating the tape-cartridge mover to move the tape cartridge from the home position to the bypass position comprises actuating the tape-cartridge mover to pivot the mounting plate and the roller arm downward.

20. The method of claim 14, further comprising, responsive to the case-bypass condition being met, actuating a top-head-assembly actuator to raise a top-head assembly to a position above a top surface of the case.

* * * * *